US006792928B2

(12) United States Patent
Yasui et al.

(10) Patent No.: US 6,792,928 B2
(45) Date of Patent: Sep. 21, 2004

(54) DEGRADATION DETERMINING SYSTEM AND METHOD FOR EXHAUST GAS SENSOR, AND ENGINE CONTROL UNIT

(75) Inventors: Yuji Yasui, Saitama-ken (JP); Yosuke Ishikawa, Saitama-ken (JP); Shintaro Minowa, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/702,429

(22) Filed: Nov. 7, 2003

(65) Prior Publication Data

US 2004/0094138 A1 May 20, 2004

(30) Foreign Application Priority Data

Nov. 8, 2002 (JP) ..... 2002-325606

(51) Int. Cl.[7] ..... F02B 75/08

(52) U.S. Cl. ..... 123/688; 123/479; 701/109; 73/118.1

(58) Field of Search ..... 123/688, 479; 701/109, 101, 102, 99; 73/118.1; 204/401

(56) References Cited

U.S. PATENT DOCUMENTS 5,325,711 A * 7/1994 Hamburg et al. ..... 73/118.1
5,363,091 A * 11/1994 Kotwicki et al. ..... 340/439
5,365,216 A * 11/1994 Kotwicki et al. ..... 340/439
5,758,494 A * 6/1998 Davey ..... 60/274
6,308,697 B1 * 10/2001 Surnilla et al. ..... 123/672
6,370,935 B1 * 4/2002 He et al. ..... 73/1.34
6,539,704 B1 * 4/2003 Surnilla et al. ..... 60/274
6,564,543 B1 * 5/2003 Orzel et al. ..... 60/277
6,568,177 B1 * 5/2003 Surnilla ..... 60/285

* cited by examiner

*Primary Examiner*—John T. Kwon
(74) *Attorney, Agent, or Firm*—Squire, Sanders & Dempsey L.L.P.

(57) ABSTRACT

There is provided a degradation determining system for an exhaust gas sensor, which, even when unexpected changes occur in the air-fuel ratio during execution of air-fuel ratio control, can determine degradation of the sensor by suppressing adverse influence of noise caused by the changes on the output from the sensor, to thereby enhance the accuracy of the degradation determination. In the degradation determining system, a determining input signal IDSIN for determining the degradation of the sensor is generated, and a modulation output (u(k), DSMSGNS(k), $u_s$(k), or $u_d$(k)) is generated by modulating the determining input signal IDSIN by using any one of the ΔΣ modulation algorithm, the ΣΔ modulation algorithm, and the Δ modulation algorithm. Degradation of the sensor is determined based on the output KACT delivered from the sensor when the fuel injection amount is controlled based on the generated modulation output.

21 Claims, 13 Drawing Sheets

DEGRADATION DETERMINING SYSTEM AND METHOD FOR EXHAUST GAS SENSOR, AND ENGINE CONTROL UNIT

BACKGROUND OF THE INVENTION

1. Field of the Invention

This invention relates to a degradation determining system and method for an exhaust gas sensor and an engine control unit, which determine degradation of the exhaust gas sensor based on an output from the exhaust gas sensor, the exhaust gas sensor outputting a signal indicative of the amount of a predetermined component contained in exhaust gases emitted from an internal combustion engine into an exhaust passage thereof.

2. Description of the Related Art

Conventionally, a degradation determining system of the aforementioned kind has been disclosed e.g. in the publication of Japanese Patent No. 2978960 (seventh column at page 4 to fifteenth column at page 8, and FIG. 3 and FIGS. 7 to 10). This degradation determining system determines degradation of an air-fuel ratio sensor that outputs a signal indicative of a sensed concentration of oxygen contained in the exhaust gases. The degradation of the air-fuel ratio sensor is determined during feedback control of the air-fuel ratio of a mixture supplied to the engine, which is provided in response to an output from the air-fuel ratio sensor. More specifically, when the output from the air-fuel ratio sensor assumes, for example, a richer value than a threshold value equivalent to a stoichiometric air-fuel ratio, an air-fuel ratio correction coefficient for controlling the air-fuel ratio of the mixture is decremented each time by a predetermined value, whereby the air-fuel ratio of the mixture is progressively changed in the leaning direction. Then, after a time point the output from the air-fuel ratio sensor crosses the above threshold value in the leaning direction, the control of the air-fuel ratio is held at the resulting state until a predetermined time period elapses. Upon the lapse of the predetermined time period, the air-fuel ratio correction coefficient starts to be incremented each time by a predetermined value, whereby the air-fuel ratio is changed in the enriching direction. Then, after a time point the output from the air-fuel ratio sensor crosses the above threshold value in the enriching direction, the state of control of the air-fuel ratio is held at the resulting state until a predetermined time period elapses. The above air-fuel ratio control for changing the air-fuel ratio in the leaning direction and then in the enriching direction is repeatedly carried out to see if the cycle of changes in the output from the air-fuel ratio sensor during provision of the above-described air-fuel ratio control is equal to or larger than a predetermined reference value, and when the cycle is equal to or larger than the predetermined reference value, it is determined that the air-fuel ratio sensor is degraded.

However, according to the above conventional degradation determining system, the air-fuel ratio is progressively increased and decreased, and therefore, during execution of the degradation determining process, if the opening degree of the throttle valve is changed due to an unintended slight change in the degree of depression of an accelerator pedal by the driver, the fuel injection amount is increased or decreased in response thereto to cause changes in the air-fuel ratio. This changes the cycle of changes in the output from the air-fuel ratio sensor. Further, there is a case in which even with the same fuel injection amount, the actual air-fuel ratio can vary due to variation in adhesion properties of fuel.

In such a case as well, the output from the air-fuel ratio sensor undergoes changes in the cycle. If noise caused by such unexpected changes in the air-fuel ratio during provision of the above-described control of the air-fuel ratio is mixed into the output from the air-fuel ratio sensor, there is a fear that the accuracy of the determination of degradation of the air-fuel ratio sensor is lowered.

SUMMARY OF THE INVENTION

It is an object of the present invention to provide a degradation determining system and method for an exhaust gas sensor and an engine control unit, which are capable of determining degradation of the exhaust gas sensor, while suppressing influence of noise caused by unexpected changes in the air-fuel ratio of a mixture on the output from the exhaust gas sensor during provision of control of the air-fuel ratio, thereby enhancing the accuracy of the determination of degradation of the exhaust gas sensor.

To attain the above object, in a first aspect of the present invention, there is provided a degradation determining system for an exhaust gas sensor, for determining degradation of the exhaust gas sensor based on an output from the exhaust gas sensor, the exhaust gas sensor outputting a signal indicative of an amount of a predetermined component contained in exhaust gases emitted from an internal combustion engine into an exhaust passage thereof, the degradation determining system comprising:

determining input-generating means for generating a determining input for determining degradation of the exhaust gas sensor;

modulation output-generating means for generating a modulation output by modulating the generated determining input, using any one of a $\Delta\Sigma$ modulation algorithm, a $\Sigma\Delta$ modulation algorithm, and a $\Delta$ modulation algorithm;

control means for controlling an amount of fuel to be injected into the engine, according to the generated modulation output; and degradation determining means for determining degradation of the exhaust gas sensor based on the output from the exhaust gas sensor delivered when the amount of fuel to be injected is controlled by the control means.

With the arrangement of the degradation determining system according to the first aspect of the present invention, a determining input for determining degradation of the exhaust gas sensor is modulated using any one of the $\Delta\Sigma$ modulation algorithm, the $\Sigma\Delta$ modulation algorithm, and the $\Delta$ modulation algorithm, thereby generating a modulation output. The amount of fuel to be injected into the engine (fuel injection amount) is controlled according to the generated modulation output, and at the same time degradation of the exhaust gas sensor is determined based on the output from the exhaust gas sensor delivered when the fuel injection amount is controlled by the control means. The above-mentioned three modulation algorithms output a signal indicative of a value of +1 or a value of −1, and therefore, by setting the gain of the modulation output to an appropriate value, the fuel injection amount can be varied with a relatively large amplitude. This makes it possible to vary the fuel injection amount with a larger amplitude than a range of changes in the fuel injection amount causing the unexpected changes in the air-fuel ratio described hereinabove. This makes it possible to make the unexpected changes in the air-fuel ratio obscure or lost in changes in the air-fuel ratio the range of which is controlled by the above-described control of the fuel injection amount. As a result, it is possible to suppress adverse influence of noise caused by the unexpected changes in the air-fuel ratio on the output from the exhaust gas sensor. Further, since the degradation of the exhaust gas sensor is determined based on the output from the exhaust gas sensor delivered in a state where the adverse influence of noise caused by the unexpected changes in the air-fuel ratio on the output from the exhaust gas sensor is suppressed as described above, it is possible to enhance the accuracy of the determination of degradation of the sensor.

Preferably, the degradation determining system further comprises a bandpass filter for filtering the output from the exhaust gas sensor input thereto, such that components of the output from the exhaust gas sensor corresponding to a predetermined frequency band including a frequency of the determining input are allowed to pass therethrough, and the degradation determining means determines degradation of the exhaust gas sensor based on the output of the exhaust gas sensor, the output having been filtered by the bandpass filter.

With the arrangement of this preferred embodiment, the degradation of the exhaust gas sensor is determined based on the output from the exhaust gas sensor, which has been filtered by the bandpass filter, in other words, based on components of the output from the exhaust gas sensor within a predetermined frequency band including the frequency of the determining input. Thus, by filtering the output of the exhaust gas sensor using the bandpass filter, it is possible to eliminate noise caused by unexpected changes in the air-fuel ratio even if the noise is contained in an unfiltered output from the exhaust gas sensor. This makes it possible to determine the degradation of the exhaust gas sensor while eliminating adverse influence of the noise on the output from the exhaust gas sensor, and therefore further enhance the accuracy of the determination of degradation of the exhaust gas sensor.

Preferably, the degradation determining means determines degradation of the exhaust gas sensor based on the output from the exhaust gas sensor, after a predetermined time period has elapsed from a start of control of the amount of fuel to be injected by the control means.

With the arrangement of this preferred embodiment, the degradation of the exhaust gas sensor is determined based on an output from the exhaust gas sensor delivered after a predetermined time period has elapsed from the start of control of the fuel injection amount by the control means. This makes it possible to determine the degradation of the exhaust gas sensor based on the output from the exhaust gas sensor, after the fuel injection amount has been positively controlled by the control means, and therefore it is possible to obtain the effects provided by the above-described control of the fuel injection amount.

Preferably, the degradation determining means determines degradation of the exhaust gas sensor based on a state of changes in amplitude of the output from the exhaust gas sensor.

With the arrangement of this preferred embodiment, the degradation of the exhaust gas sensor is determined based on the state of changes in amplitude of the output from the exhaust gas sensor. As described above, the air-fuel ratio can be accurately changed with a relatively large amplitude by controlling the fuel injection amount according to the modulation output, and therefore if the exhaust gas sensor is normally operating, the output therefrom changes with an amplitude corresponding to the above amplitude of the air-fuel ratio. Therefore, as described above, it is possible to determine the degradation of the exhaust gas sensor based on the amplitude of changes in the output from the exhaust gas sensor.

Preferably, the degradation determining system further comprises cumulative value-generating means for generating a cumulative value by adding up a plurality of values of the output from the exhaust gas sensor delivered at respective different times, and the degradation determining means determines degradation of the exhaust gas sensor based on the generated cumulative value.

With the arrangement of this preferred embodiment, the degradation of the exhaust gas sensor is determined based on a cumulative value obtained by adding up a plurality of outputs from the exhaust gas sensor delivered at respective different times. As a result, when noise caused by unexpected changes in the air-fuel ratio is temporarily contained in the output from the exhaust gas sensor, it is possible to determine the degradation of the exhaust gas sensor while more effectively eliminating the adverse influence of the noise on the output from the exhaust gas sensor, thereby enabling accurate determination of the degradation of the exhaust gas sensor.

Preferably, the control means controls the amount of fuel to be injected according to a value obtained by adding together the modulation output generated by the modulation output-generating means and a predetermined value.

For example, when the air-fuel ratio of a mixture is controlled such that it becomes equal to a target air-fuel ratio, along with control of the fuel injection amount according to the modulation output, an actual air-fuel ratio sometimes becomes leaner or richer than the above target air-fuel ratio depending on characteristics of the internal combustion engine (adhesiveness of fuel, response of injectors, etc.). In such a case, the emission-reducing capability of a three-way catalyst for reducing exhaust emissions is not sufficiently exhibited, which can lead to increased exhaust emissions. According to this preferred embodiment, however, the fuel injection amount is controlled according to a value obtained by adding together the modulation output and a predetermined value, and therefore by setting the predetermined value in advance to such a value that compensates for a deviation of the actual air-fuel ratio from the target air-fuel ratio, as described above, it is possible to prevent the exhaust emissions from being increased due to the deviation. This makes it possible to maintain excellent exhaust emission characteristics during execution of the degradation determining process.

Preferably, the exhaust gas sensor is an air-fuel ratio sensor that outputs a signal indicative of a sensed concentration of oxygen contained in the exhaust gases, and the degradation determining system further comprises correction means for correcting the amount of fuel to be injected in response to the output from the air-fuel ratio sensor.

With the arrangement of this preferred embodiment, the fuel injection amount is corrected in response to the output from the air-fuel ratio sensor, whereby even when the actual air-fuel ratio is deviated toward the leaner side or the richer side with respect to the target air-fuel ratio due to the characteristics of the engine, as described above, this deviation can be controlled. This makes it possible to prevent the exhaust emissions from being increased due to the deviation.

To attain the above object, in a second aspect of the present invention, there is provided a degradation determining method of determining degradation of an exhaust gas sensor based on an output from the exhaust gas sensor, the exhaust gas sensor outputting a signal indicative of an amount of a predetermined component contained in exhaust gases emitted from an internal combustion engine into an exhaust passage thereof, the degradation determining method comprising the steps of:

generating a determining input for determining degradation of the exhaust gas sensor;

generating a modulation output by modulating the generated determining input, using any one of a ΔΣ modulation algorithm, a ΣΔ modulation algorithm, and a Δ modulation algorithm;

controlling an amount of fuel to be injected into the engine, according to the generated modulation output; and determining degradation of the exhaust gas sensor based on the output from the exhaust gas sensor delivered when the amount of fuel to be injected is controlled in the controlling step.

With the arrangement of the degradation determining method according to the second aspect of the invention, it is possible to obtain the same advantageous effects as provided by the first aspect of the present invention.

Preferably, the degradation determining method further comprises the step of inputting the output from the exhaust gas sensor to a bandpass filter to thereby perform filtering such that components of the output from the exhaust gas sensor corresponding to a predetermined frequency band including a frequency of the determining input are allowed to pass therethrough, and the degradation determining step includes determining degradation of the exhaust gas sensor based on the output of the exhaust gas sensor, the output having been filtered by the bandpass filter.

Preferably, the degradation determining step includes determining degradation of the exhaust gas sensor based on the output from the exhaust gas sensor, after a predetermined time period has elapsed from a start of control of the amount of fuel to be injected in the controlling step.

Preferably, the degradation determining step includes determining degradation of the exhaust gas sensor based on a state of changes in amplitude of the output from the exhaust gas sensor.

Preferably, the degradation determining method further comprises the step of generating a cumulative value by adding up a plurality of values of the output from the exhaust gas sensor delivered at respective different times, and the degradation determining step includes determining degradation of the exhaust gas sensor based on the generated cumulative value.

Preferably, the controlling step includes controlling the amount of fuel to be injected according to a value obtained by adding together the modulation output generated in the modulation output-generating step and a predetermined value.

Preferably, the exhaust gas sensor is an air-fuel ratio sensor that outputs a signal indicative of a sensed concentration of oxygen contained in the exhaust gases, and the degradation determining method further includes the step of correcting the amount of fuel to be injected in response to the output from the air-fuel ratio sensor.

With the arrangements of these preferred embodiments, it is possible to obtain the same advantageous effects as provided by the corresponding preferred embodiments of the first aspect of the present invention.

To attain the above object, in a third aspect of the present invention, there is provided an engine control unit including a control program for causing a computer to perform a degradation determining process for determining degradation of an exhaust gas sensor based on an output from the exhaust gas sensor, the exhaust gas sensor outputting a signal indicative of an amount of a predetermined component contained in exhaust gases emitted from an internal combustion engine into an exhaust passage thereof, wherein the program causes the computer to generate a determining input for determining degradation of the exhaust gas sensor, generate a modulation output by modulating the generated determining input, using any one of a ΔΣ modulation algorithm, a ΣΔ modulation algorithm, and a Δ modulation algorithm, control an amount of fuel to be injected into the engine, according to the generated modulation output, and determine degradation of the exhaust gas sensor based on the output from the exhaust gas sensor delivered when the program causes the computer to control the amount of fuel to be injected based on the generated modulation output.

With the arrangement of the engine control unit according to the third aspect of the invention, it is possible to obtain the same advantageous effects as provided by the first aspect of the present invention.

Preferably, the program causes the computer to input the output from the exhaust gas sensor to a bandpass filter to thereby cause the bandpass filter to perform filtering such that components of the output from the exhaust gas sensor corresponding to a predetermined frequency band including a frequency of the determining input are allowed to pass through the bandpass filter, and when the program causes the computer to determine degradation of the exhaust gas sensor, the program causes the computer to determine degradation of the exhaust gas sensor based on the output of the exhaust gas sensor, the output having been filtered by the bandpass filter.

Preferably, when the program causes the computer to determine degradation of the exhaust gas sensor, the program causes the computer to determine degradation of the exhaust gas sensor based on the output from the exhaust gas sensor, after a predetermined time period has elapsed from a start of control of the amount of fuel to be injected based on the generated modulation output.

Preferably, when the program causes the computer to determine degradation of the exhaust gas sensor, the program causes the computer to determine degradation of the exhaust gas sensor based on a state of changes in amplitude of the output from the exhaust gas sensor.

Preferably, the program causes the computer to generate a cumulative value by adding up a plurality of values of the output from the exhaust gas sensor delivered at respective different times, and when the program causes the computer to determine degradation of the exhaust gas sensor, the program causes the computer to determine degradation of the exhaust gas sensor based on the generated cumulative value.

Preferably, when the program causes the computer to control the amount of fuel to be injected based on the generated modulation output, the program causes the computer to control the amount of fuel to be injected according to a value obtained by adding together the modulation output and a predetermined value.

Preferably, the exhaust gas sensor is an air-fuel ratio sensor that outputs a signal indicative of a sensed concentration of oxygen contained in the exhaust gases, and the program causes the computer to correct the amount of fuel to be injected in response to the output from the air-fuel ratio sensor.

With the arrangements of these preferred embodiments, it is possible to obtain the same advantageous effects as provided by the corresponding preferred embodiments of the first aspect of the present invention.

The above and other objects, features, and advantages of the present invention will become more apparent from the following detailed description taken in conjunction with the accompanying drawings.

DETAILED DESCRIPTION OF THE PREFERRED EMBODIMENTS

Figure 1:
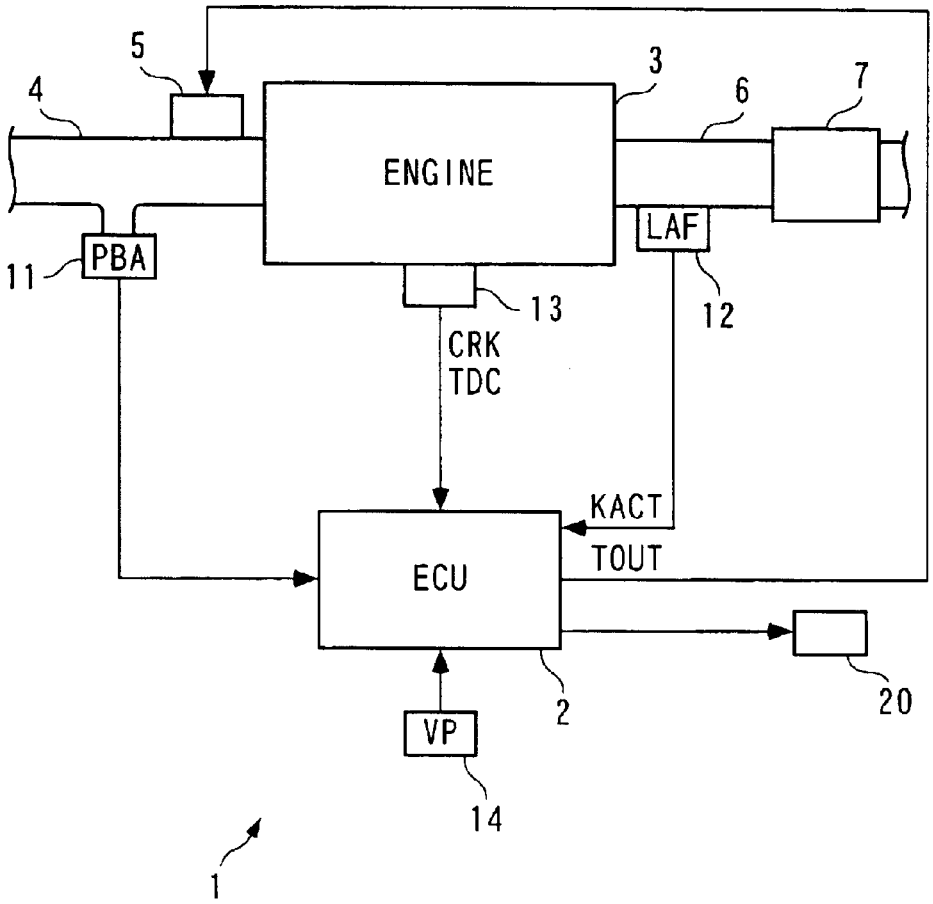
FIG. 1 is a block diagram schematically showing the arrangement of a degradation determining system according to the present invention, and an internal combustion engine incorporating a LAF sensor to which is applied the degradation determining system.

The invention will now be described in detail with reference to the drawings showing preferred embodiments thereof. Referring first to FIG. 1, there is schematically shown the arrangement of a degradation determining system 1 according to a first embodiment of the present invention, and an internal combustion engine (hereinafter simply referred to as "the engine") 3 incorporating a LAF sensor 12 (exhaust gas sensor) to which is applied the degradation determining system 1. The degradation determining system 1 includes an ECU 2.

The engine 3 is a straight type four-cylinder gasoline engine, for instance. An intake pipe 4 of the engine 3 has an intake manifold, not shown, into which are inserted injectors 5 (only one of which is shown) in a manner facing respective combustion chambers, not shown, of cylinders. Each injector 5 has its fuel injection time period TOUT (fuel injection amount) over which the injector 5 is open, controlled by a drive signal delivered from the ECU 2. Further, the intake pipe 4 has an intake pipe absolute pressure sensor 11 inserted therein at a location upstream of the injector 5 and downstream of a throttle valve, not shown. The intake pipe absolute pressure sensor 11 is implemented e.g. by a semiconductor absolute pressure sensor for detecting an intake pipe absolute pressure PBA within the intake pipe 4 to deliver an electric signal indicative of the sensed intake pipe absolute pressure PBA to the ECU 2.

The LAF sensor 12 and a three-way catalyst 7 are mounted in an exhaust pipe 6 (exhaust passage) of the engine 3 at respective locations, from upstream to downstream, in the mentioned order. The LAF sensor 12 detects the concentration of oxygen contained in exhaust gases linearly in a wide range of the air-fuel ratio ranging from a rich region to a lean region, to deliver an output KACT (output from an exhaust gas sensor) proportional to the sensed oxygen concentration to the ECU 2. The output KACT is expressed as an equivalent ratio proportional to the reciprocal of the air-fuel ratio. When heated to a temperature equal to or higher than a predetermined temperature (e.g. 300° C.), the three-way catalyst 7 is activated and reduces harmful substances (HC, CO and $NO_x$) in exhaust gases passing therethrough by oxidation-reduction catalytic actions thereof. The emission-reducing capability of the three-way catalyst 7 is maximized when the air-fuel ratio is equal to the stoichiometric air-fuel ratio, that is, when the value of the output KACT from the LAF sensor 12 assumes 1.0 (value of the equivalent ratio corresponding to the stoichiometric air-fuel ratio).

The ECU 2 receives a CRK signal and a TDC signal, which are both pulse signals, delivered from a crank angle sensor 13 in accordance with rotation of a crankshaft, not shown, and an electric signal indicative of a speed VP of a vehicle, not shown, (hereinafter referred to as "the vehicle speed VP") delivered from a vehicle speed sensor 14. The crankshaft angle sensor 13 delivers the CRK signal whose pulse is generated whenever the crankshaft rotates through a predetermined angle (e.g. 30 degrees) to the ECU 2. The ECU 2 calculates a rotational speed NE of the engine 3 (hereinafter referred to as "the engine speed NE") based on the CRK signal. The TDC signal indicates that each piston, not shown, in an associated cylinder is in a predetermined crank angle position immediately before the TDC position at the start of the intake stroke of the piston, and each pulse of the TDC signal is generated whenever the crankshaft rotates through a predetermined angle.

Further, the ECU 2 has a warning lamp 20 connected thereto. When the ECU 2 determines, through execution of a degradation determining process, described hereinafter, that the LAF sensor 12 is degraded, the ECU 2 turns on the warning lamp 20 so as to notify the driver of the fact.

The ECU 2 is implemented by a microcomputer including an I/O interface, a CPU, a RAM, and a ROM, none of which are shown. The ECU 2 determines operating conditions of the engine 3, based on the outputs from the aforementioned sensors 11 to 14, and in dependence on the determined operating conditions of the engine 3, calculates a fuel injection time period TOUT of each injector 5, on a cylinder-by-cylinder basis, according to control programs and data read from the ROM, data stored in the RAM, and the like. Then, the ECU 2 delivers a drive signal generated based on the fuel injection time period TOUT to the injector 5, to thereby control the air-fuel ratio of a mixture supplied to the engine 3. More specifically, the ECU 2 executes the feedback (hereinafter abbreviated to "F/B") control of the air-fuel ratio such that the output KACT from the LAF sensor 12 is converged to a target air-fuel ratio KCMD. Further, the ECU 2 sets the target air-fuel ratio KCMD by searching a map, not shown, according to the engine speed NE and the intake pipe absolute pressure PBA. Furthermore, as described hereinafter, the ECU 2 carries out the degradation determining process for determining degradation of the LAF sensor 12, based on the output KACT from the LAF sensor 12, and the air-fuel ratio control process, referred to hereinafter, adapted to the degradation determining process during execution thereof. It should be noted that in the present embodiment, determining input-generating means, modulation output-generating means, control means, degradation determining means, a bandpass filter, cumulative value-generating means, and correction means are implemented by the ECU 2.

Figure 2:
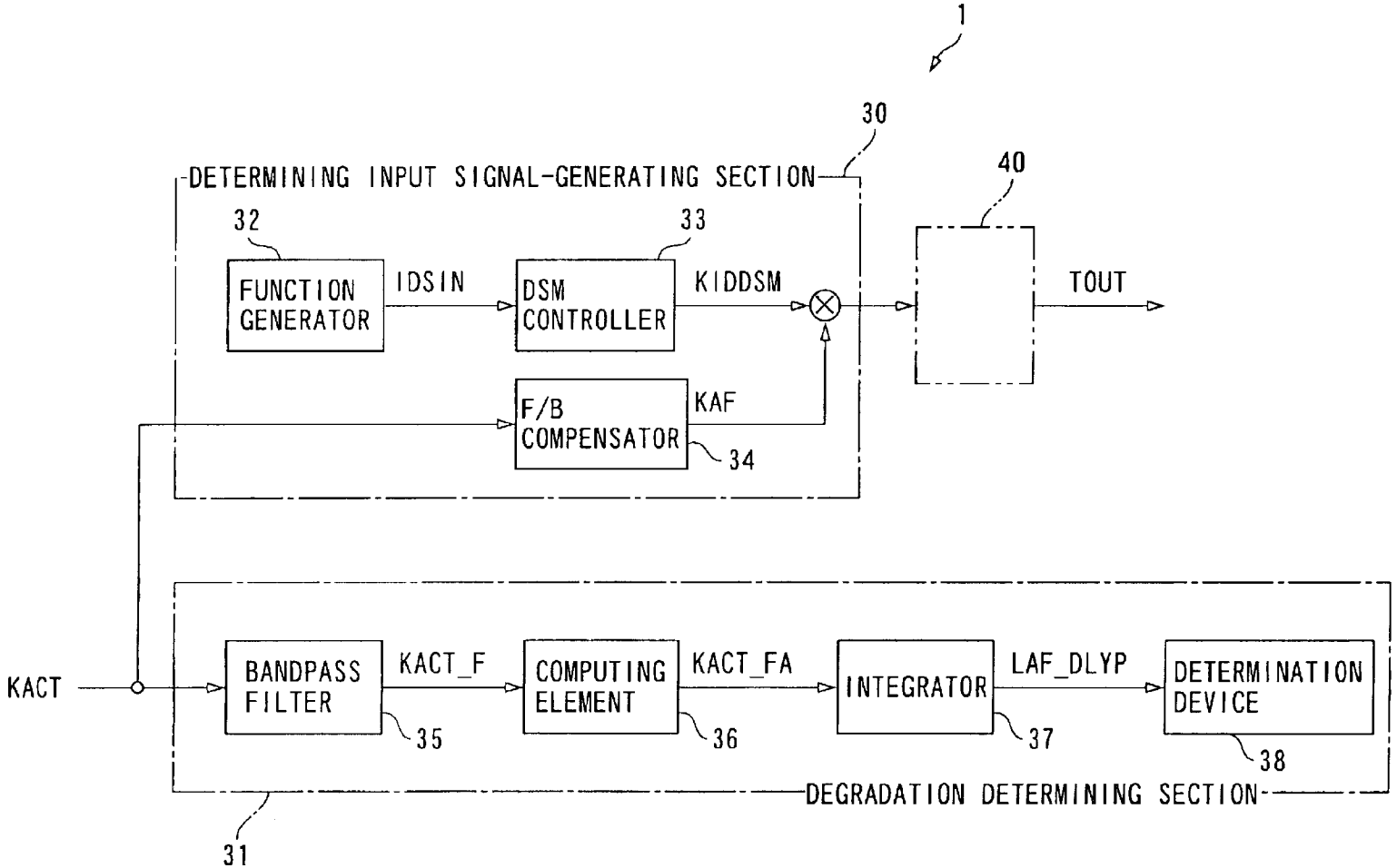
FIG. 2 is a block diagram showing the arrangement of a determining input signal-generating section, a fuel injection amount-generating section and a degradation determining section of the degradation determining system.

Referring to FIG. 2, the degradation determining system 1 is comprised of a determining input signal-generating section 30 for setting (generating) a predetermined coefficient, a fuel injection time period-calculating section 40 for calculating the fuel injection time period TOUT based on the predetermined coefficient, and a degradation determining section 31 for determining the degradation of the LAF sensor 12, all of which are implemented by the ECU 2.

The determining input signal-generating section 30 includes a function generator 32 (determining input-generating means), a DSM controller 33 (modulation output-generating means), and a F/B-compensator 34 (correction means).

The function generator 32 generates a determining input signal IDSIN (determining input) for determining the degradation of the LAF sensor 12, during execution of the degradation determining process, and outputs the signal to the DSM controller 33. The determining input signal IDSIN is of a sinusoidal wave set to have a predetermined frequency fid (e.g. 2 Hz: frequency of the determining input).

The DSM controller 33 calculates (generates) a fuel reflection coefficient KIDDSM based on the determining input signal IDSIN generated by the function generator 32, using a control algorithm to which the ΔΣ modulation algorithm is applied, during execution of the degradation determining process. The DSM controller 33 and the operation thereof for calculating the fuel reflection coefficient KIDDSM will be described in detail hereinafter.

The F/B-compensator 34 calculates an F/B correction coefficient KAF. The F/B correction coefficient KAF is set to a value obtained by multiplying an observer feedback correction coefficient #nKLAF and a correction coefficient KFB by each other. It should be noted that the observer feedback correction coefficient #nKLAF is calculated by PID control, according to an actual air-fuel ratio estimated by an observer for each cylinder from the output KACT from the LAF sensor 12. Further, the correction coefficient KFB is set to a value calculated by the PID control according to a deviation between the output KACT from the LAF sensor 12 and the target air-fuel ratio KCMD, or to a value obtained by multiplying the target air-fuel ratio KCMD by a coefficient calculated by a Self Tuning Regulator type adaptive controller, not shown, depending on the operating conditions of the engine 3.

The fuel injection time period-calculating section 40 calculates the fuel injection time period TOUT using a value obtained by multiplying the fuel reflection coefficient KIDDSM and the F/B correction coefficient KAF, calculated as above, by each other, and the target air-fuel ratio KCMD, depending on the operating conditions of the engine 3 including the engine speed NE and the intake pipe absolute pressure PBA.

The degradation determining section 31 includes a bandpass filter 35, a computing element 36, an integrator 37 (cumulative value-generating means), and a determination device 38 (degradation determining means).

Figure 3:
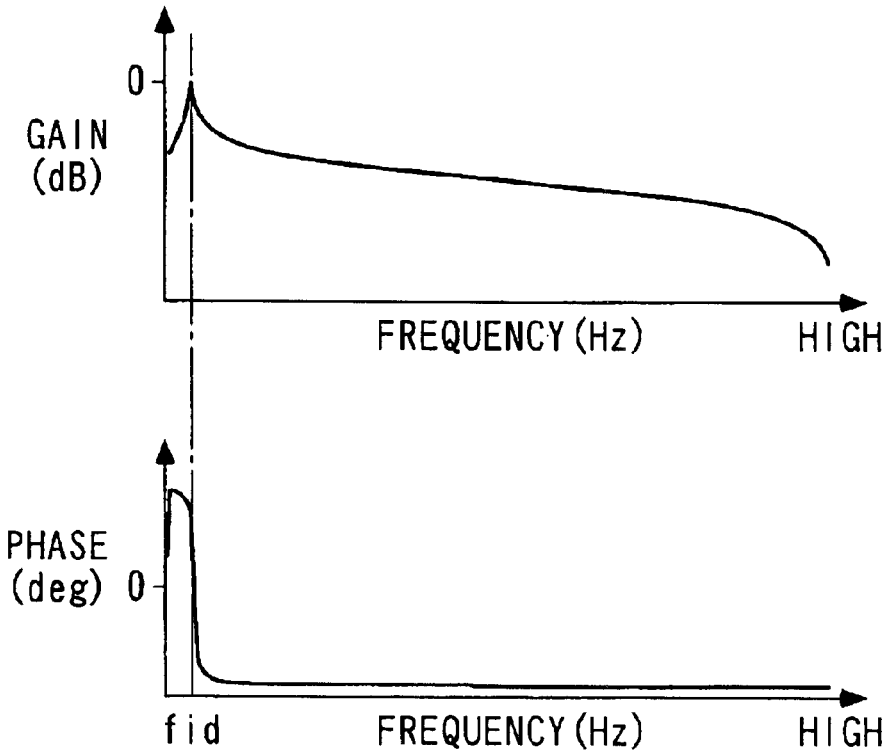
FIG. 3 is a diagram showing the gain characteristics and phase characteristics of a band-pass filter.

The bandpass filter 35 filters the output KACT from the LAF sensor 12 such that components of the output KACT from the LAF sensor 12 in a predetermined frequency band including the predetermined frequency fid of the determining input signal IDSIN described above are allowed to pass therethrough, to thereby generate a filtered value KACT_F (filtered output from the exhaust gas sensor). The bandpass filter 35 has gain characteristics and phase characteristics, as shown in FIG. 3. Its gain is set such it becomes equal to a value of OdB when the frequency of the output KACT from the LAF sensor 12 is equal to the predetermined frequency fid. In the band-pass filter 35, the filtered value KACT_F is calculated (generated) using the following equation (1):

$$\begin{aligned}\mathrm{KACT_F}(k) = {} & a1\cdot\mathrm{KACT_F}(k-1) + a2\cdot\mathrm{KACT_F}(k-2) + \\ & a3\cdot\mathrm{KACT_F}(k-3) + b0\cdot KACT(k) + b1\cdot KACT(k-1) + \\ & b2\cdot KACT(k-2) + b3\cdot KACT(k-3)\end{aligned} \tag{1}$$

wherein a1, a2, a3, b0, b1, b2, and b3 represent predetermined filter coefficients, respectively.

The computing element 36 calculates (generates) an amplitude absolute value KACT_FA (indicative of a state of changes in amplitude of the output from the exhaust gas sensor) which is the absolute value of the amplitude the filtered value KACT_F calculated as described above. The integrator 37 integrates the amplitude absolute value KACT_FA as described hereinafter, to thereby calculate (generate) a determining parameter LAF_DYLP (cumulative value). The determination device 38 determines the degradation of the LAF sensor 12 based on the determining parameter LAF_DYLP, as will be described hereinafter.

Figure 4:
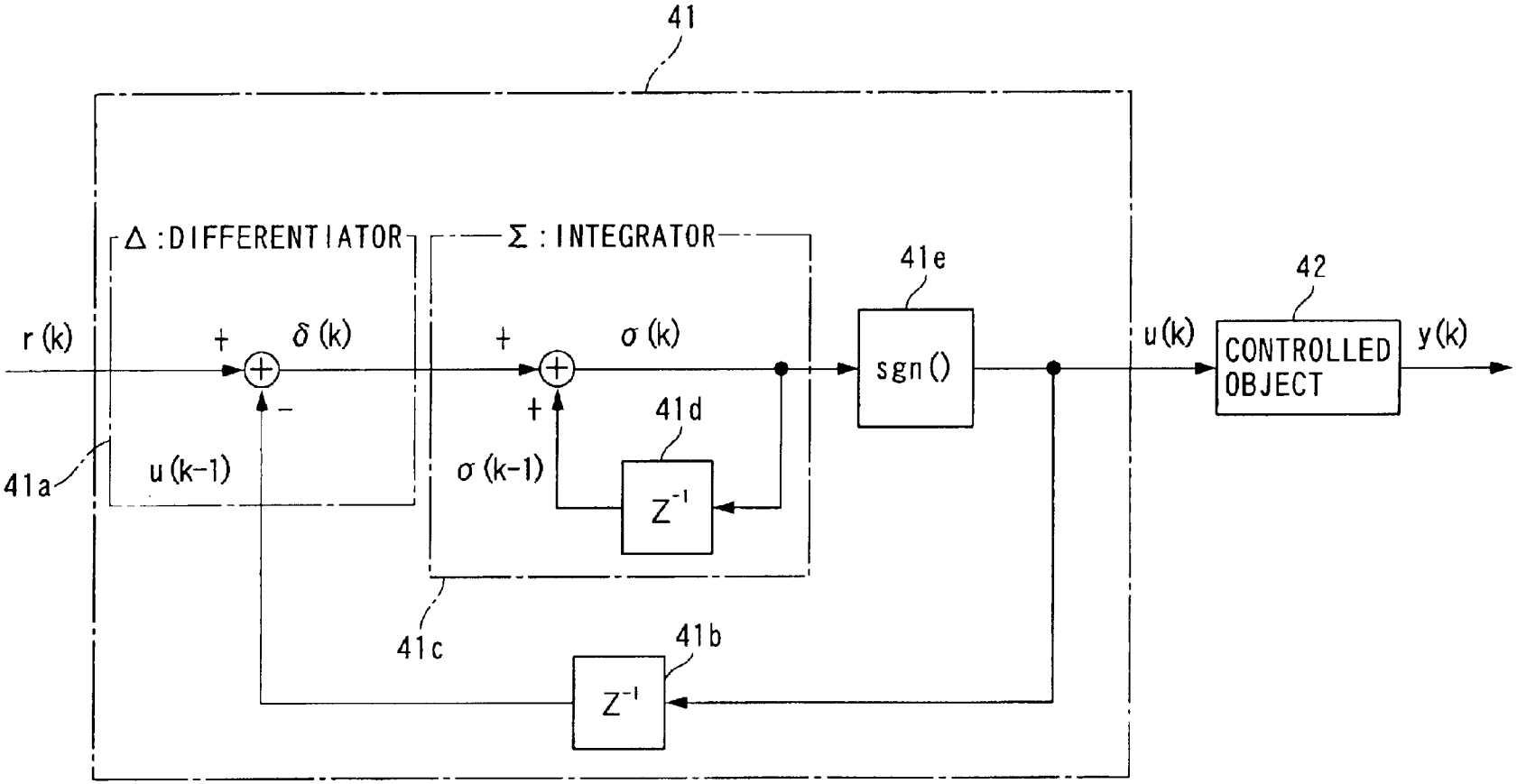
FIG. 4 is a block diagram showing the arrangement of a controller that executes ΔΣ modulation, and a control system incorporating the controller.

Next, a description will be given of the DSM controller 33. Before giving the description of the DSM controller 33, a general ΔΣ modulation algorithm will be explained which forms a basis of the DSM controller 33. FIG. 4 shows the construction of a control system in which a controller 41 having the ΔΣ modulation algorithm applied thereto controls a controlled object 42. As shown in FIG. 4, in the controller 41, a deviation signal δ(k) is generated by a differentiator 41*a*, as a deviation of a DSM output u(k−1) obtained by delaying the DSM output u(k) using a delay element 41*b*, from a reference input r(k). Then, the integral of the deviation (hereinafter referred to as "a deviation integral value") σ(k) is generated by an integrator 41*c*, as a signal of the sum obtained by adding together the deviation signal δ(k) and a deviation integral value σ(k−1) obtained by delaying the deviation integral value σ(k) using a delay element 41*d*. Subsequently, the DSM output u(k) (modulation output) is generated by a quantizer 41*e* (sign (signum) function), as a signal indicative of a sign determined based on the deviation integral value σ(k). The DSM output u(k) thus generated is input to the controlled object 42, and an output signal y(k) is output from the controlled object 42 in response thereto.

The above ΔΣ modulation algorithm can be expressed by the following equations (2) to (4):

$$\delta(k)=r(k)-u(k-1) \tag{2}$$

$$\sigma(k)=\sigma(k-1)+\delta(k) \tag{3}$$

$$u(k)=sgn(\sigma(k)) \tag{4}$$

provided that the sign function sgn(σ(k)) is configured to assume a value of 1 when σ(k)≧0 holds, and a value of −1 when σ(k)<0 holds. It should be noted that the sign function sgn(σ(k)) may be configured to assume a value of 0 when σ(k)=0 holds.

Figure 5:
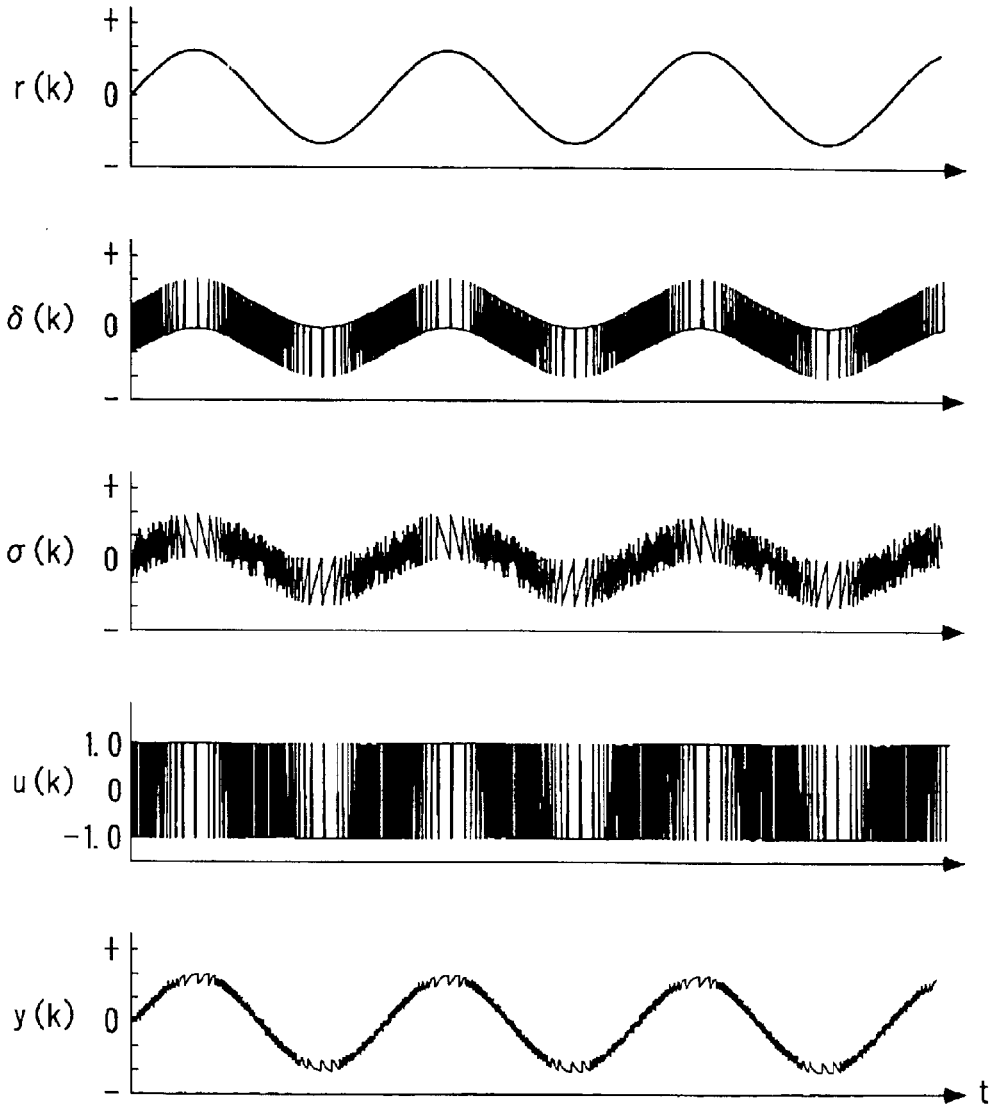
FIG. 5 is a timing chart showing an example of results of control operations executed by the FIG. 4 control system.

FIG. 5 shows results of a simulation of control by the above control system. As shown in FIG. 5, when the sinusoidal reference signal r(k) is input to the control system, the DSM output u(k) is generated as a rectangular signal, and when the DSM output u(k) is input to the controlled object 42, the output signal y(k) different in amplitude from the reference input r(k), but identical in frequency to the same is output from the controlled object 42. Although noise is contained, the output signal y(k) has a waveform similar to that of the reference input r(k) as a whole. Thus, the ΔΣ modulation algorithm is characterized in that the DSM output u(k) can be generated from the reference input r(k), as a value which when input to the controlled object 42, causes the output y(k) from the controlled object 42 to be generated as a signal different in amplitude from the reference input r(k), but identical in frequency and similar in waveform as a whole to the same. In other words, the characteristic of the ΔΣ modulation algorithm lies in that the DSM output u(k) can be generated as a value which causes the reference input r(k) to be reproduced in the actual output y(k) from the controlled object 42.

The DSM controller 33, by utilizing the above characteristic of the ΔΣ modulation algorithm, generates the fuel reflection coefficient KIDDSM during executing of the degradation determining process for determining the degradation of the LAF sensor 12, such that the output KACT from the LAF sensor 12 is not changed according to unexpected changes in the air-fuel ratio. More specifically, the fuel reflection coefficient KIDDSM is calculated (generated) according to a value obtained by multiplying the DSM output u(k) by an amplitude-adjusting gain F, referred to hereinafter, whereby the fuel reflection coefficient KIDDSM is changed with a relatively large amplitude. Accordingly, similarly to the fuel reflection coefficient KIDDSM, the fuel injection time period TOUT as well, which is calculated as described above according to the fuel reflection coefficient KIDDSM, can be changed with a relatively large amplitude, so that it is possible to make changes in the fuel injection time period TOUT, which can cause the unexpected changes in the air-fuel ratio, obscure or lost in changes in the fuel injection time period TOUT the range of which is controlled as described above. As a result, it is possible to suppress adverse influence of noise caused by the changes in the fuel injection time period TOUT on the output KACT from the LAF sensor 12. As described above, during execution of the degradation determining process, the air-fuel ratio control using the fuel reflection coefficient KIDDSM calculated as above, that is, the air-fuel ratio control process adapted to the degradation determination is carried out.

Figure 6:
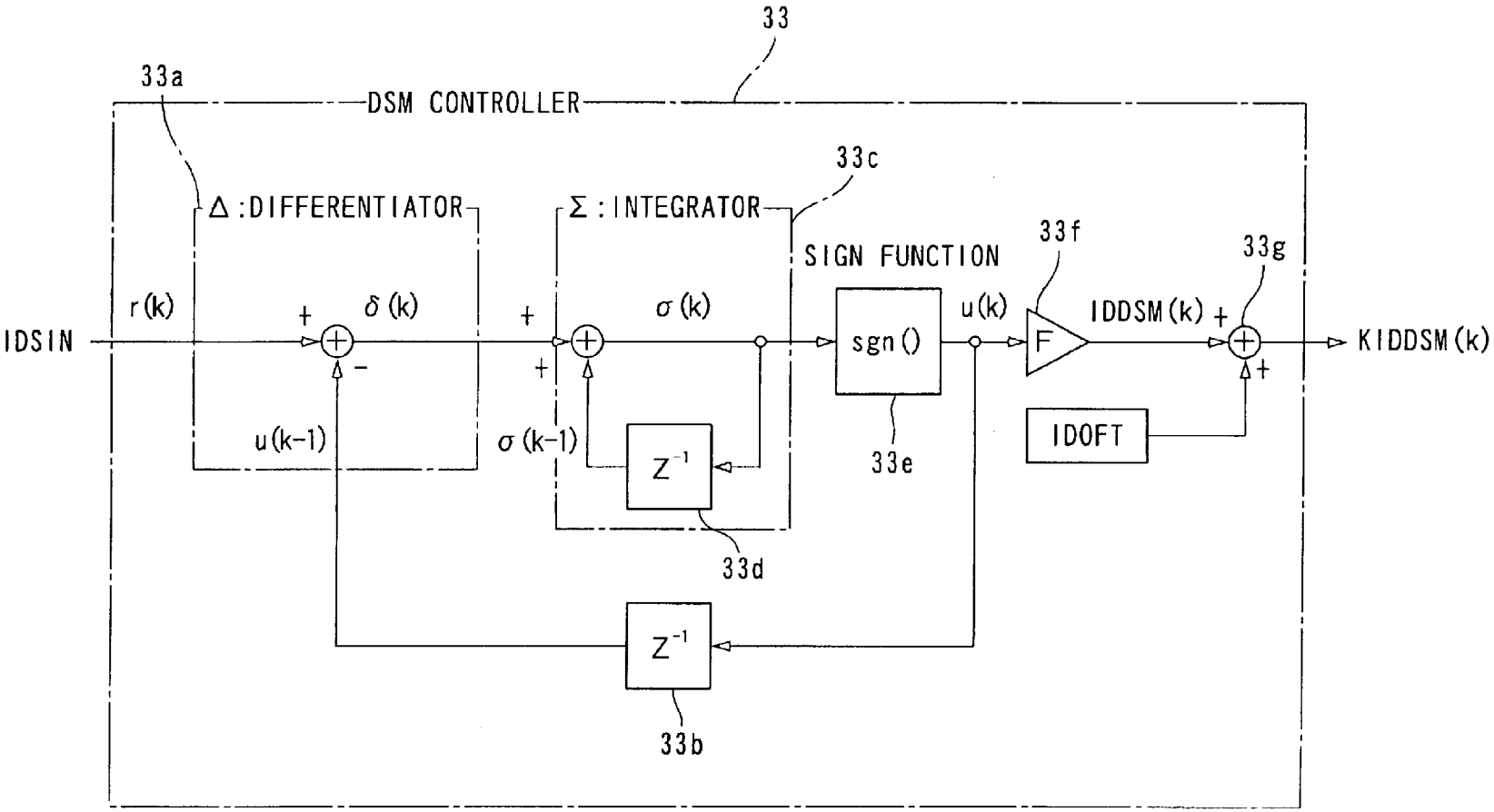
FIG. 6 is a block diagram showing the arrangement of a DSN controller.

More specifically, as shown in FIG. 6, to the DSM controller 33, the determining input signal IDSIN generated by the function generator 32 described above is input as the reference signal r(k). Then, a deviation signal δ(k) is generated by a differentiator 33*a* as a deviation of a DSM output u(k−1) obtained by delaying a DSM output u(k) using a delay element 33*b*, from the reference signal r(k).

Subsequently, an integrator 33*c* generates a deviation integral value a (k) as a signal of the sum obtained by adding together the deviation signal δ(k) and a deviation integral value σ(k−1) obtained by delaying the deviation integral value σ(k) using a delay element 33*d*, whereafter a quantizer 33*e* (sign function) generates the DSM output u(k) as a value indicative of a sign determined based on the deviation integral value σ(k). Further, an amplifier 33*f* generates an amplified DSM output IDDSM(k) as a value obtained by amplifying the DSM output u(k) by the amplitude-adjusting gain F, and then an adder 33*g* adds together the amplified DSM output IDDSM(k) and a predetermined offset value IDOFT (predetermined value) to thereby generate a fuel reflection coefficient KIDDSM(k).

The control algorithm used by the above DSN controller 33 can be expressed by the following equations (5) to (9):

$$\delta(k) = r(k) - u(k-1) = IDSIN(k) - u(k-1) \quad (5)$$

$$\sigma(k)=\delta(k)+\sigma(k-1) \quad (6)$$

$$u(k)=sgn(\sigma(k)) \quad (7)$$

$$IDDSM(k)=F\cdot u(k) \quad (8)$$

$$KIDDSM(k)=IDOFT+IDDSM(k) \quad (9)$$

Here, the value of the amplitude-adjusting gain F is set to a predetermined value (e.g. 0.1 A/F). Further, the predetermined offset value IDOFT is set through experiments such that the output KACT from the LAF sensor 12 becomes closer to the target air-fuel ratio KCMD, when the air-fuel ratio is controlled using the fuel injection time period TOUT calculated according to the fuel reflection coefficient KIDDSM. Furthermore, the sign function sgn(σ(k)) is configured to assume a value of 1 (sgn(σ(k))=1) when σ(k)≧0 holds, and a value of −1 (sgn(σ(k))=−1) when σ(k)<0 holds. It should be noted that the sign function sgn(σ(k)) may be configured to assume a value of 0 (sgn(σ(k))=0) when σ(k)=0 holds.

Figure 7:
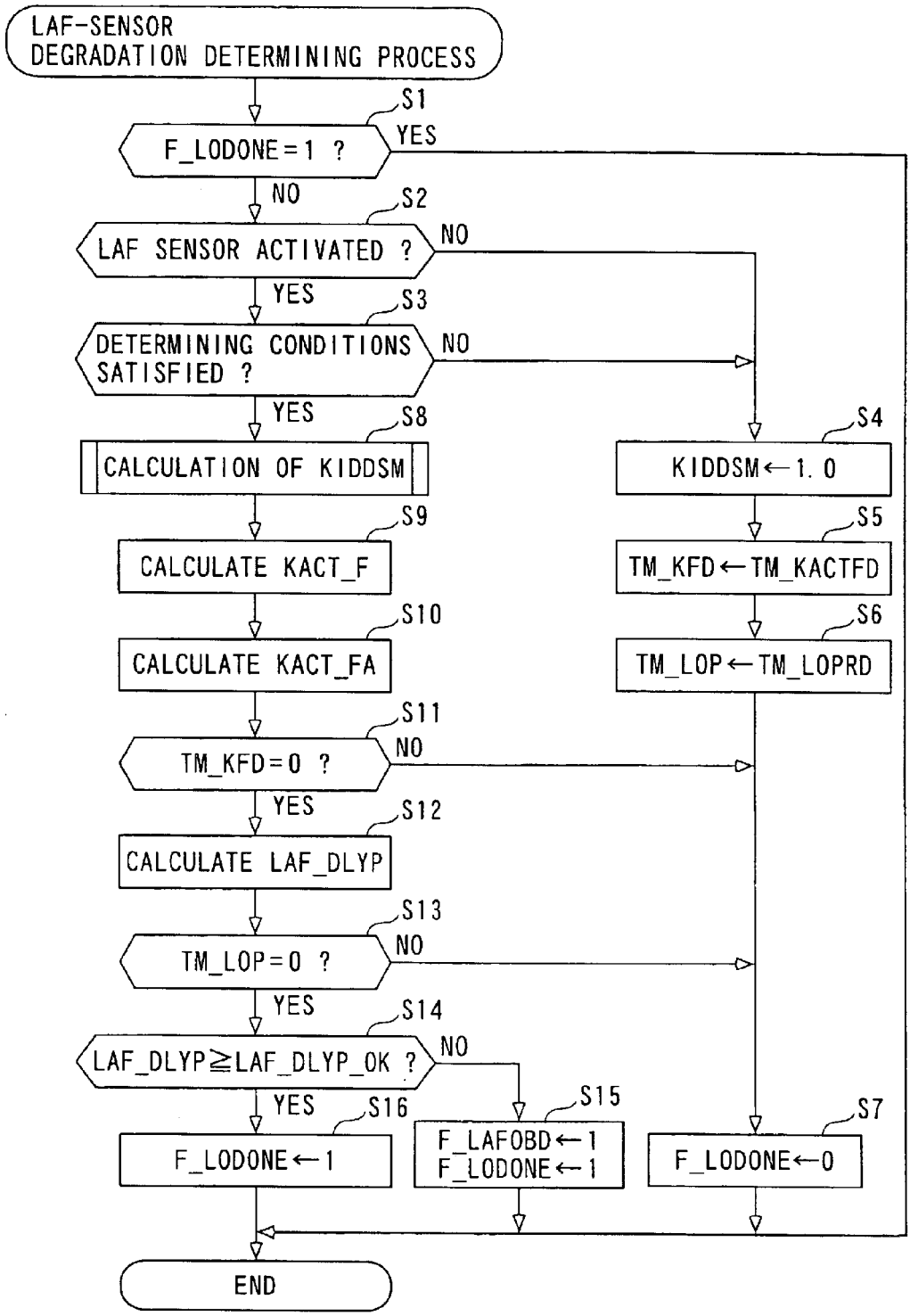
FIG. 7 is a flowchart showing a degradation determining process.

Next, the degradation determining process for determining the degradation of the LAF sensor 12 will be described in detail with reference to a flowchart shown in FIG. 7. This process is carried out in synchronism with the count (e.g. 10 msec of a timer. First, in a step 1 (in FIG. 1, shown as "S1"; which rule applies similarly in the following description), it is determined whether or not a degradation determination completion flag F_LODONE is set to 1. If the answer to this question is affirmative (YES), i.e. if the degradation determining process has already been completed, the present program is immediately terminated.

If the answer to the question of the step 1 is negative (NO), i.e. if the degradation determining process is not completed, the program proceeds to a step 2 wherein it is determined whether or not the LAF sensor 12 has been activated and then to a step 3 wherein it is determined whether or not determining conditions for determining the degradation of the LAF sensor 12 are satisfied. In the former step, it is determined that the LAF sensor 12 has been activated, when the difference between an output voltage of the LAF sensor 12 and a center voltage thereof is smaller than a predetermined value (e.g. 0.4 V), and in the latter step, it is determined that the above determining conditions are satisfied, which indicates that a vehicle, not shown, on which the engine is installed is in a steady operating condition, when there are satisfied all of the following six conditions:

(a) The vehicle speed VP is higher than a predetermined lower limit value VPLO_L (e.g. 40 km/h), and at the same time lower than a predetermined upper limit value VPLO_H (e.g. 120 km/h).

(b) The engine speed NE is higher than a predetermined lower limit value NELO_L (e.g. 1800 rpm), and at the same time lower than a predetermined upper limit value NELO_H (e.g. 2500 rpm).

(c) The intake pipe absolute pressure PBA is higher than a predetermined lower limit value PBLO_L (e.g. 360 mmHg), and at the same time lower than a predetermined upper limit value PBLO_H (e.g. 510 mmHg).

(d) The absolute value |ΔVP| of the amount of change in the vehicle speed VP per unit time is smaller than a predetermined value VPMI (e.g. 4 km/h).

(e) The absolute value |ΔNE| of the amount of change in the engine speed NE per unit time is smaller than a predetermined value NEMI (e.g. 200 rpm).

(f) The absolute value |ΔPBA| of the amount of change in the intake pipe absolute pressure PBA per unit time is smaller than a predetermined value PBMI (e.g. 30 mmHg).

The above six conditions are set to the determining conditions for the following reason: As described hereinafter, the degradation determining system 1 calculates the fuel reflection coefficient KIDDSM, as described above, and thereby changes the fuel injection time period TOUT with a relatively large amplitude, to cause changes in the air-fuel ratio of the mixture supplied to the engine with a relatively large amplitude. Then, the degradation determining system 1 determines whether or not the output KACT from the LAF sensor 12 indicates a state of changes corresponding to the changes in the air-fuel ratio caused by the fuel reflection coefficient KIDDSM, to thereby determine the degradation of the LAF sensor 12. Further, if any one of the above six conditions remains unsatisfied, the vehicle is in an unstable operating condition, and therefore coefficients other than the fuel reflection coefficient KIDDSM used in calculation of the fuel injection time period TOUT can be changed to make the air-fuel ratio unstable. If the air-fuel ratio is unstable, there is a fear that the degradation determining system 1, which determines the degradation of the LAF sensor 12 as described above, cannot properly determine the degradation of the LAF sensor 12.

Therefore, if either of the answers of the questions of the steps 2 and 3 is negative (NO), it is judged that the degradation of the LAF sensor 12 cannot be properly determined. Therefore, the fuel reflection coefficient KIDDSM is set to 1.0 in a step 4, a timer count TM_KFD of a downcount standby timer is set to a predetermined standby time period TM_KACTFD (e.g. 0.5 seconds; predetermined time period) in a step 5, and a timer count TM_LOP of a determining timer is set to a predetermined determining time period TM_LOPRD (e.g. 2.5 seconds) in a step 6. Then, in a step 7, to indicate that the degradation determining process has not been completed, the degradation determination completion flag F_LODONE is set to 0, followed by terminating the present program. As described hereinabove, if the LAF sensor 12 has not been activated, or if any of the above determining conditions is not satisfied, the fuel reflection coefficient KIDDSM is set to 1.0. As a result, the fuel injection time period TOUT is calculated using the F/B correction coefficient KAF and the target air-fuel ratio KCMD, depending on the operating conditions of the engine 3, whereby the air-fuel ratio is controlled such that the output KACT from the LAF sensor 12 becomes equal to the target air-fuel ratio KCMD.

On the other hand, if the answers of the questions of the steps 2 and 3 are both affirmative (YES), i.e. if the LAF sensor 12 has been activated, and at the same time the above determining conditions are satisfied, a fuel reflection coefficient KIDDSM-calculating process for calculating the fuel reflection coefficient KIDDSM is carried out in a step 8. As described above, the fuel reflection coefficient KIDDSM is calculated (generated) by the DSM controller 33 based on the determining input signal IDSIN generated by the function generator 32.

Figure 8:
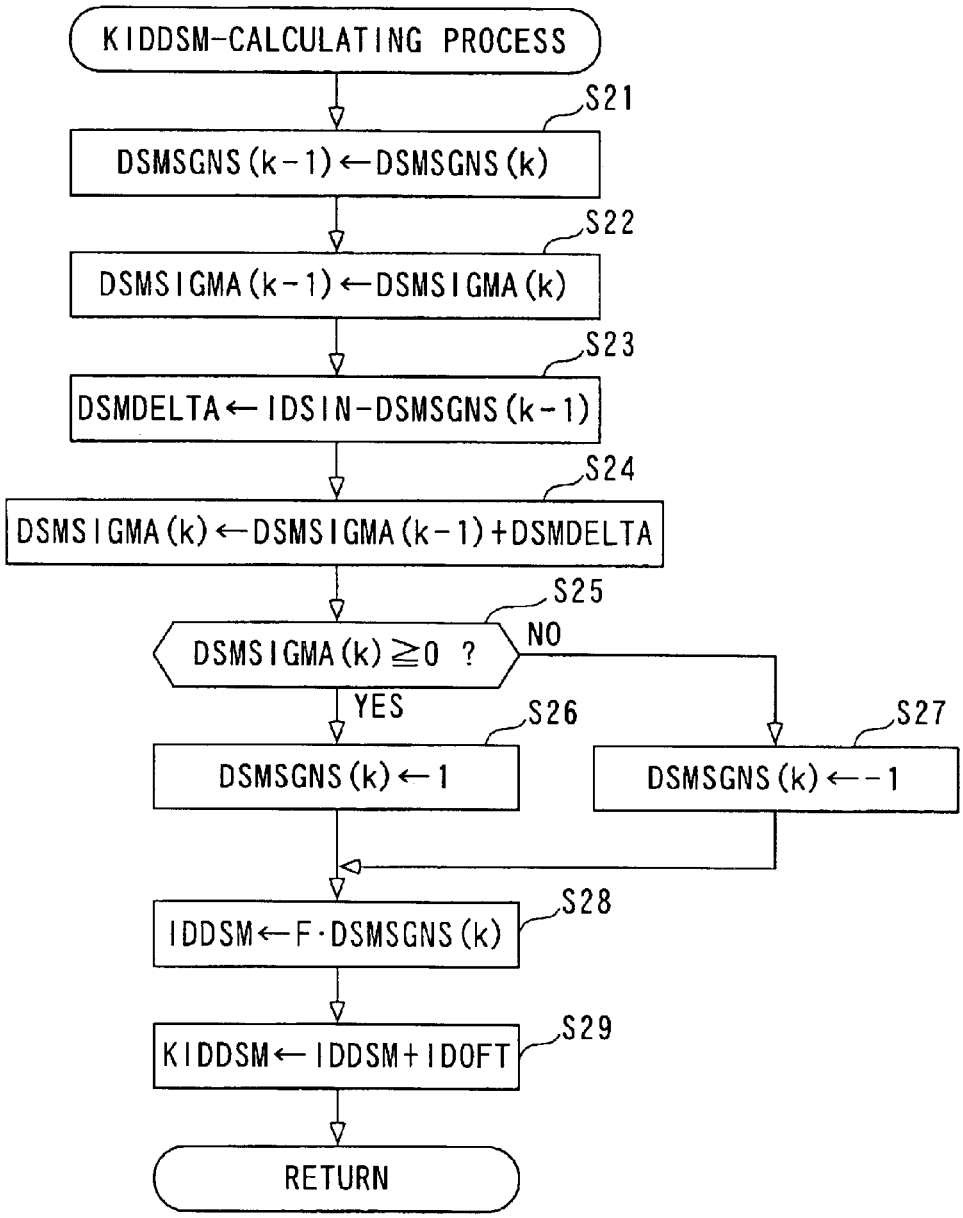
FIG. 8 is a flowchart showing a subroutine for carrying out a KIDDSM-calculating process executed in a step 8 in FIG. 7.

FIG. 8 is a flowchart showing a subroutine for carrying out the fuel reflection coefficient KIDDSM-calculating process. First, in a step 21, the present value DSMSGNS(k) [=u(k), modulation output] of the DSM output calculated in the preceding loop and stored in the RAM is set to the immediately preceding value DSMSGNS(k−1)[=u(k−1)].

Then, the program proceeds to a step 22, wherein the present value DSMSIGMA(k)[=σ(k)] of the deviation integral value calculated in the immediately preceding loop is set to the immediately preceding value DSMSIGMA(k−1) [=σ(k−1)] thereof.

Subsequently, in a step 23, a value [IDSIN−DSMSGNS (k−1)] obtained by subtracting the immediately preceding value DSMSGNS(k−1) of the DSM output from the determining input signal IDSIN is set to a deviation signal value DSMDELTA[=δ(*k*)]. This process corresponds to the above-mentioned equation (5).

Next, in a step 24, the sum [DSMSIGMA(k−1)+ DSMDELTA] obtained by adding together the immediately preceding value DSMSIGMA(k−1) of the deviation integral value and the deviation signal value DSMDELTA is set to the present value DSMSIGMA(k) of the deviation integral value. This process corresponds to the above-mentioned equation (6).

Then, the program proceeds to steps 25 to 27, wherein if the present value DSMSIGMA(k) of the deviation integral value calculated in the step 24 is equal to or larger than 0 (S25), the present value DSMSGNS(k) of the DSM output is set to 1.0 (S26), whereas if the present value DSMSIGMA (k) is smaller than 0, the present value DSMSGNS(k) of the DSM output is set to −1.0 (S27). The process carried out in the steps 25 to 27 corresponds to the above-mentioned equation (7).

Next, in a step 28, a value obtained by multiplying the amplitude-adjusting gain F and the present value DSMSGNS(k) of the DSM output set in the step 26 or 27 by each other is set to the amplified DSM output IDDSM. This process corresponds to the above-mentioned equation (8).

Then, in a step 29, the sum obtained by adding together the amplified DSM output IDDSM calculated in the step 28 and the offset value IDOFT is set to the fuel reflection coefficient KIDDSM, followed by terminating the present program. This process corresponds to the above-mentioned equation (9). The air-fuel ratio is changed with a relatively large amplitude by carrying out the air-fuel ratio control using the fuel reflection coefficient KIDDSM calculated by the KIDDSM-calculating process, that is, the air-fuel ratio control process adapted to the degradation determination.

Referring again to FIG. 7, in a step 9 following the step 8, the filtered value KACT_F is calculated. As describe hereinbefore, the filtered value KACT_F is calculated using the above-mentioned equation (1), as a value obtained by extracting only components contained in the predetermined frequency band including the predetermined frequency fid of the determining input signal IDSIN, from the output KACT from the LAF sensor 12.

Subsequently, in a step 10, the amplitude absolute value KACT_FA is calculated based on the filtered value KACT_F calculated in the step 9, and it is determined in a step 11 whether or not the timer count TM_KFD of the standby timer, set in the step 5, is equal to 0. If the answer to this question is negative (NO), i.e. if the predetermined standby time period TM_KACTFD has not elapsed after the start of the air-fuel ratio control process adapted to the degradation determination, the step 7 is executed, followed by terminating the present program without determining the degradation of the LAF sensor 12. As described above, if the predetermined standby time period TM_KACTFD has not elapsed after the start of the air-fuel ratio control process adapted to the degradation determination, the degradation of the LAF sensor 12 is not executed. This is for the following reason: There is a delay of a certain time period before the output KACT from the LAF sensor 12 indicates a value corresponding to a mixture supplied to a cylinder of the engine 3. Therefore, as described above, the lapse of the predetermined standby time period TM_KACTFD is awaited from the start of the air-fuel ratio control process adapted to the degradation determination, whereby it is ensured that the degradation determination can be properly executed based on the output KACT from the LAF sensor 12 delivered after the air-fuel ratio has been positively controlled by the degradation determining process. Further, the standby time period after the start of the air-fuel ratio control process, which is set by the predetermined standby time period TM_KACTFD, also plays the role of causing the degradation determining system to wait for the filtered value KACT_F to be made stable, since attenuation of the initial response of the filtered value KACT_F is awaited thereby.

Therefore, if the answer to the question of the step 11 is affirmative (YES), i.e. if the TM_KFD=0 holds, it is judged that the air-fuel ratio has been controlled by the air-fuel ratio control process adapted to the degradation determination, and a determining parameter LAF_DLYP is calculated in a step 12. In this case, the determining parameter LAF_DLYP is calculated as the sum obtained by adding together the immediately preceding value thereof and the amplitude absolute value KACT_FA. If the present loop is a first loop to be executed immediately after the start of the present program, the determining parameter LAF_DLYP is set to the present amplitude absolute value KACT_FA.

In a step 13 following the step 12, it is determined whether or not the timer count TM_LOP of the determining timer set in the step 6 is equal to 0. If the answer to this question is negative (NO), the step 7 is carried out, followed by terminating the present program without determining the degradation of the LAF sensor 12.

If the answer to the question of the step 13 is affirmative (YES), i.e. if TM_LOP=0 holds, which means that calculation of the determining parameter LAF_DLYP is repeatedly carried out a plurality of times corresponding to the predetermined determining time period TM_LOPRD from the start of the air-fuel ratio control process adapted to the degradation determination, it is determined in a step 14 whether or not the present determining parameter LAF_DLYP is equal to or larger than a predetermined reference value LAF_DLYP_OK (e.g. 0.001). As described above, the determining parameter LAF_DLYP is set to a value obtained by integrating the amplitude absolute value KACT_FA calculated whenever the present program is carried out, over a time period from the start of the air-fuel ratio control until the lapse of the predetermined determining time period TM_LOPRD.

If the answer to the question of the step 14 is negative (NO), i.e. if LAF_DLYP<LAF_DLYP_OK holds, although the air-fuel ratio is changed with a relatively large amplitude by the fuel injection time period TOUT calculated using the fuel reflection coefficient KIDDSM as described above, the output KACT from the LAF sensor 12 does not show changes corresponding to the changes in the air-fuel ratio. Therefore, it is judged that the LAF sensor 12 is degraded, and a degradation flag F_LAFOBD is set to 1, and the degradation determination completion flag F_LODONE is set to 1 in a step 15, followed by terminating the present program. Accordingly, the warning lamp 20 for warning the driver of the degradation of the LAF sensor 12 is turned on.

On the other hand, if the answer to the question of the step 14 is affirmative (YES), i.e. if LAF_DLYP≧LAF_DLYP_OK holds, it is judged that the output KACT from the LAF sensor 12 undergoes sufficiently large changes in a manner responsive to the air-fuel ratio of the mixture supplied to the engine, which is changed with a relatively large amplitude, and hence the LAF sensor 12 is normally operating, so that the degradation determination completion flag F_LODONE is set to 1 in a step 16, followed by terminating the present program. In this case, the degradation flag F_LAFOBD is held at 0.

Figure 9:
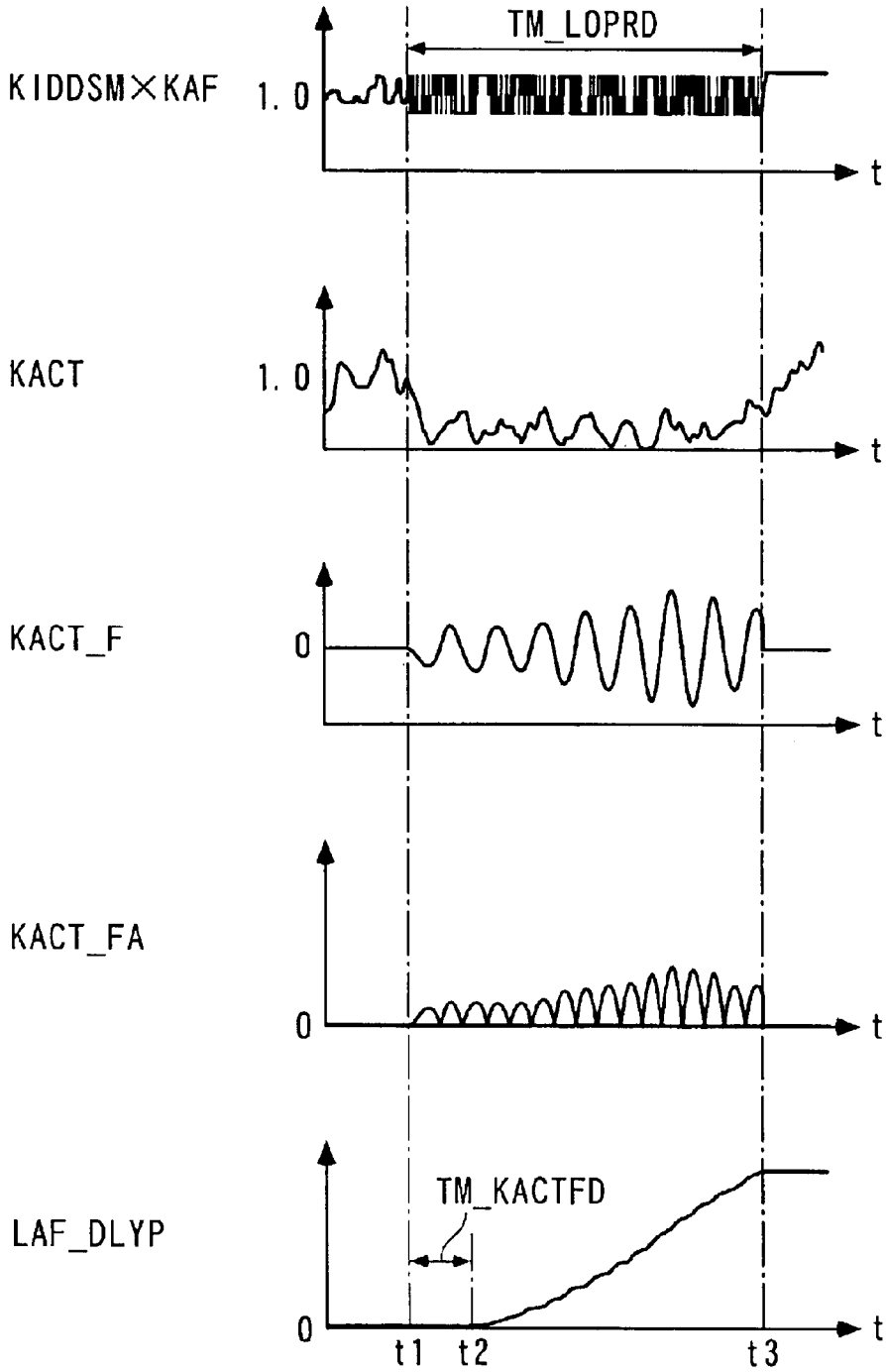
FIG. 9 is a diagram showing an example of operations of the degradation determining process, when the LAF sensor is normally operating.
Figure 10:
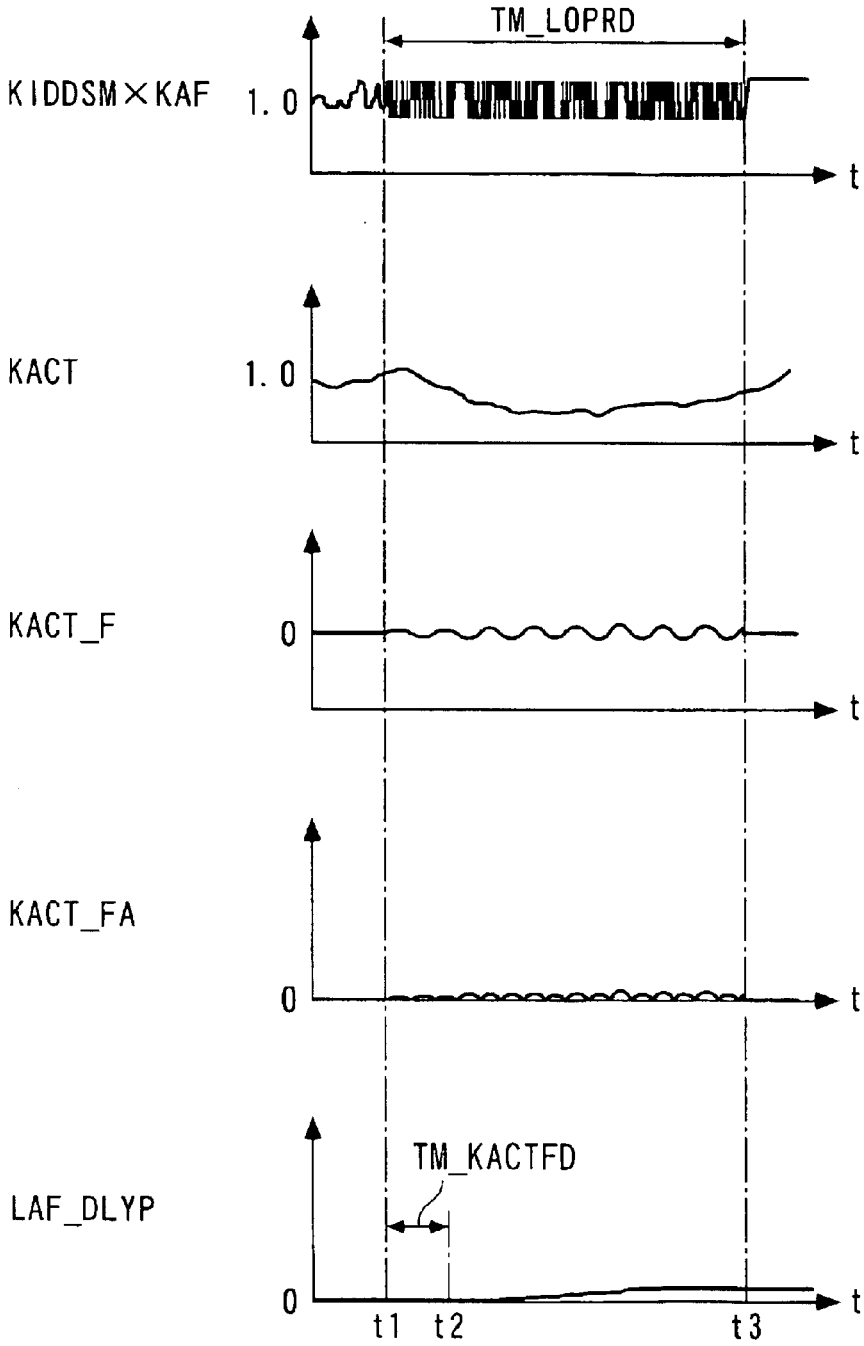
FIG. 10 is a diagram showing an example of operations of the degradation determining process, when the LAF sensor 12 is degraded.

FIGS. 9 and 10 show respective examples of operations executed by the degradation determining process, when the LAF sensor 12 is normally operating, and when the LAF sensor 12 is degraded. It should be noted that in these examples, the predetermined offset value IDOFT is set to a value of 1.0 (corresponding to the equivalent ratio of the stoichiometric air-fuel ratio). Further, in FIGS. 9 and 10, time t1 designates a time point the air-fuel ratio control process adapted to the degradation determination starts to be executed, t2 designates a time point the determining parameter LAF_DLYP starts to be calculated when the standby time period TM_KACTFD has elapsed after the start of the air-fuel ratio control process adapted to the degradation determination, and t3 designates a time point the predetermined determining time period TM_LOPRD has elapsed. Furthermore, during a time period between the time points t1 and t3, the F/B correction coefficient KAF is held at 1.0.

First, after the start of the air-fuel ratio control process adapted to the degradation determination (after t1), the fuel reflection coefficient KIDDSM is changed with respect to 1 with a relatively large amplitude corresponding to the amplitude-adjusting gain F, toward the positive side and the negative side in a rectangular waveform. Accordingly, as shown in FIG. 9, when the LAF sensor 12 is normally operating, the output KACT from the LAF sensor 12 undergoes clear waveform-like changes toward the rich side and the lean side in a manner corresponding to changes in the air-fuel ratio occurring with a relatively large amplitude according to the above fuel reflection coefficient KIDDSM. Further, the filtered value KACT_F obtained by filtering the output KACT from the LAF sensor 12 with the band-pass filter 35 changes with respect to a value of 0 toward the positive side and the negative side in a smooth and clear waveform, by elimination of noise except for components in the predetermined frequency band including the predetermined frequency fid. Further, the amplitude of the filtered value KACT_F increases with the lapse of time. The amplitude absolute value KACT_FA, which is the absolute value of the amplitude of the filtered value KACT_F, has the same tendency as that of the filtered value KACT_F, and undergoes changes with smooth, clear and large amplitudes. Further, the determining parameter LAF_DLYP, which is the cumulative value of the amplitude absolute value KACT_FA, increases at a relatively large rate with the lapse of time. Therefore, it is possible to determine that the LAF sensor 12 is normally operating, when the determining parameter LAF_DLYP is equal to or larger than the predetermined reference value LAF_DLYP_OK.

On the other hand, when the LAF sensor 12 is degraded, as shown in FIG. 10, even if the air-fuel ratio is changed with a relatively large amplitude by the fuel reflection coefficient KIDDSM after the start of the air-fuel ratio control process adapted to the degradation determination (after t1), the output KACT from the LAF sensor 12 with respect to the changes in the air-fuel ratio undergoes smaller changes and fails to exhibit clear waveform-like changes compared with the case in which the LAF sensor 12 is normally operating. Therefore, the amplitudes of the filtered value KACT_F and the amplitude absolute value KACT_FA are both very small. This also causes the determining parameter LAF_DLYP to increase at a very small rate. Therefore, when the determining parameter LAF_DLYP is smaller than the determination value LAF_DLYP_OK, it is possible to determine that the LAF sensor 12 is degraded.

As described above, according to the present embodiment, during execution of the degradation determining process, the fuel injection time period TOUT is changed with a larger amplitude than a range of changes in the fuel injection time period TOUT causing unexpected changes in the air-fuel ratio, using the fuel reflection coefficient KIDDSM calculated by utilizing the above-described characteristics of the ΔΣ modulation algorithm. This makes it possible to suppress adverse influence of noise caused by the unexpected changes in the air-fuel ratio on the output KACT from the LAF sensor 12. Therefore, it is possible to determine the degradation of the LAF sensor 12 based on the output KACT delivered when the adverse influence of noise thereon is suppressed, and thereby enhance accuracy of the determination of degradation of the LAF sensor 12. Further, since the determining parameter LAF_DLYP starts to be calculated after the lapse of the predetermined standby time period TM_KACTFD from the start of the air-fuel ratio control process adapted to the degradation determination, the determination of degradation of the sensor using the determining parameter LAF_DLYP can be carried out based on the output KACT from the LAF sensor 12 delivered after the air-fuel ratio has been positively controlled by the air-fuel ratio control process adapted to the degradation determination. This makes it possible to further enhance the accuracy of the determination of degradation of the LAF sensor 12.

Further, the filtered value KACT_F is calculated as a value obtained by filtering the output KACT from the LAF sensor 12 such that components thereof corresponding to the predetermined frequency band including the predetermined frequency fid of the determining input signal IDSIN are passed, and the determining parameter LAF_DLYP is calculated base on the filtered value KACT_F. Therefore, noise which can be contained in the output KACT from the LAF sensor 12 before filtering can be eliminated to thereby further enhance the accuracy of the determination of degradation of the LAF sensor 12. Furthermore, since the determining parameter LAF_DLYP is calculated based on the filtered value KACT_F as the cumulative value of the amplitude absolute value KACT_FA of the filtered value KACT_F, it is possible to eliminate the adverse influence of noise contained in the output KACT from the LAF sensor 12, to thereby further enhance the accuracy of the determination of degradation of the LAF sensor 12.

Further, during execution of the degradation determining process, the fuel injection time period TOUT is calculated based on the predetermined offset value IDOFT such that the output KACT from the LAF sensor 12 becomes closer to the target air-fuel ratio KCMD. This makes it possible to maintain the excellent emission-reducing capability of the three-way catalyst 7 to thereby maintain excellent exhaust emission characteristics. Furthermore, during execution of the degradation determining process, the fuel injection time period TOUT is calculated using the F/B correction coefficient KAF, whereby the F/B control of the air-fuel ratio is carried out in response to the output KACT from the LAF sensor 12. Therefore, the output KACT from the LAF sensor 12 can be always made closer to the target air-fuel ratio KCMD to thereby maintain more excellent exhaust emission characteristics.

Figure 11:
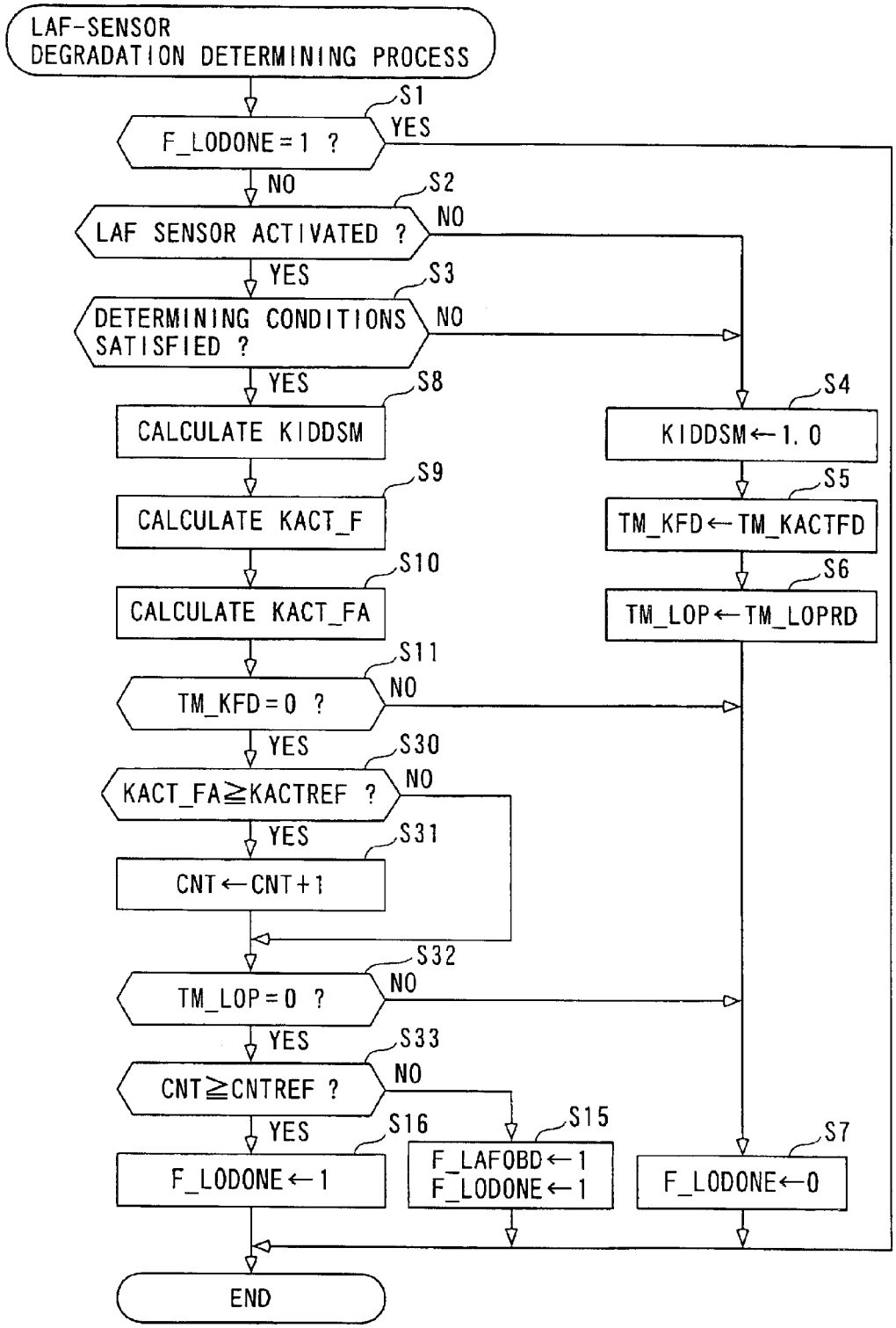
FIG. 11 is a flowchart showing a degradation determining process executed by a degradation determining system according to a second embodiment of the present invention.

Next, a second embodiment of the present invention will be described. The present embodiment is distinguished from the first embodiment only in a method of determining the degradation of the LAF sensor 12 at a final stage of the degradation determining process. More specifically, as described hereinbefore, in the first embodiment, the degradation of the LAF sensor 12 is determined using the determining parameter LAF_DLYP, which is the cumulative value of the amplitude absolute value KACT_FA. However, in the present embodiment, the degradation of the LAF sensor 12 is determined based on the number of times that the amplitude absolute value KACT_FA has exceeded a predetermined threshold value KACTREF. FIG. 11 is a flowchart showing a degradation determining process according to the present embodiment. In FIG. 11, steps similar to those of the degradation determining process according to the first embodiment are designated by identical step numbers. Further, as is apparent from FIG. 11, the degradation determining process according to the present embodiment is different from that of the first embodiment shown in FIG. 7, in steps subsequent to the step 11, so that in the following, these steps will be described in detail with reference to FIG. 11.

If the answer to the question of the step 11 is affirmative (YES), i.e. if the timer count TM_KFD=0 holds, it is determined in a step 30 whether or not the amplitude absolute value KACT_FA calculated in the step 10 is equal to or larger than the predetermined threshold value KACTREF.

If the answer to this question is affirmative (YES), the count CNT of a determination counter is incremented in a step 31, followed by the program proceeding to a step 32. On the other hand, if the answer to the above question is negative (NO), i.e. if KACT_FA<KACTREF holds, the step 31 is skipped over to the step 32.

In the step 32, it is determined whether or not the timer count TM_LOP of the determining timer set in the step 6 is equal to 0. If the answer to the above question is negative (NO), the step 7 is executed, followed by terminating the present program without determining the degradation of the LAF sensor 12.

On the other hand, if the answer to the question of the step 32 is affirmative (YES), i.e. if the timer count TM_LOP of the determining timer is equal to 0, it is determined in a step 33 whether or not the count CNT of the determination counter is equal to or larger than a predetermined value CNTREF. If the answer to this question is negative (NO), i.e. if CNT<CNTREF holds, which means that the number of times that the amplitude absolute value KACT_FA has become equal to or larger than the predetermined threshold value KACTREF does not reach the predetermined value CNTREF within the predetermined determining time period TM_LOPRD from a time point the air-fuel ratio control process adapted to the degradation determination started, it is judged that the LAF sensor 12 is degraded, and the above step 15 is executed, followed by terminating the present program. Accordingly, similarly to the case of the first embodiment, the warning lamp 20 for warning the driver of the degradation of the LAF sensor 12 is turned on.

In the above case, the LAF sensor 12 is determined to be degraded for the following reason: As described above, when the LAF sensor 12 is normally operating, the amplitude of the filtered value KACT_F is controlled to be large, whereas when the LAF sensor 12 is degraded, the amplitude of the filtered value KACT_F remains small, and the amplitude absolute value KACT_FA as well has the same tendency as that of the filtered value KACT_F. Therefore, the degradation of the LAF sensor 12 can be determined based on the number of times that the amplitude absolute value KACT_FA has exceeded the predetermined threshold value KACTREF.

On the other hand, if the answer to the question of the step 33 is affirmative (YES), i.e. if CNT≧CNTREF holds, which means that the number of times that the amplitude absolute value KACT_FA has become equal to or larger than the predetermined threshold value KACTREF has reached the predetermined value CNTREF, it is judged that the LAF sensor 12 is normally operating, and the step 16 is executed, followed by terminating the present program.

As described above, according to the second embodiment, when the number of times that the amplitude absolute value KACT_FA, which is the absolute value of the amplitude of the filtered value KACT_F, has become equal to or larger than the predetermined threshold value KACTREF has reached the predetermined value CNTREF, it is judged that the LAF sensor 12 is normally operating. Therefore, it is possible to determine the degradation of the LAF sensor 12 while eliminating adverse influence of noise caused by unexpected changes in the air-fuel ratio on the output KACT from the LAF sensor 12, and therefore enhance accuracy of determination of the LAF sensor 12. As a result, it is possible to obtain the same advantageous effects as provided by the degradation determining system 1 according to the first embodiment.

Next, a third embodiment of the present invention will be described with reference to FIG. 12. The present embodiment is distinguished from the first embodiment only in that an SDM controller 51 (modulation output-generating means) is employed instead of the DSM controller 33. The SDM controller 51 calculates the fuel reflection coefficient KIDDSM based on the determining input signal IDSIN, by utilizing a control algorithm having the ΣΔ modulation algorithm applied thereto.

Figure 12:
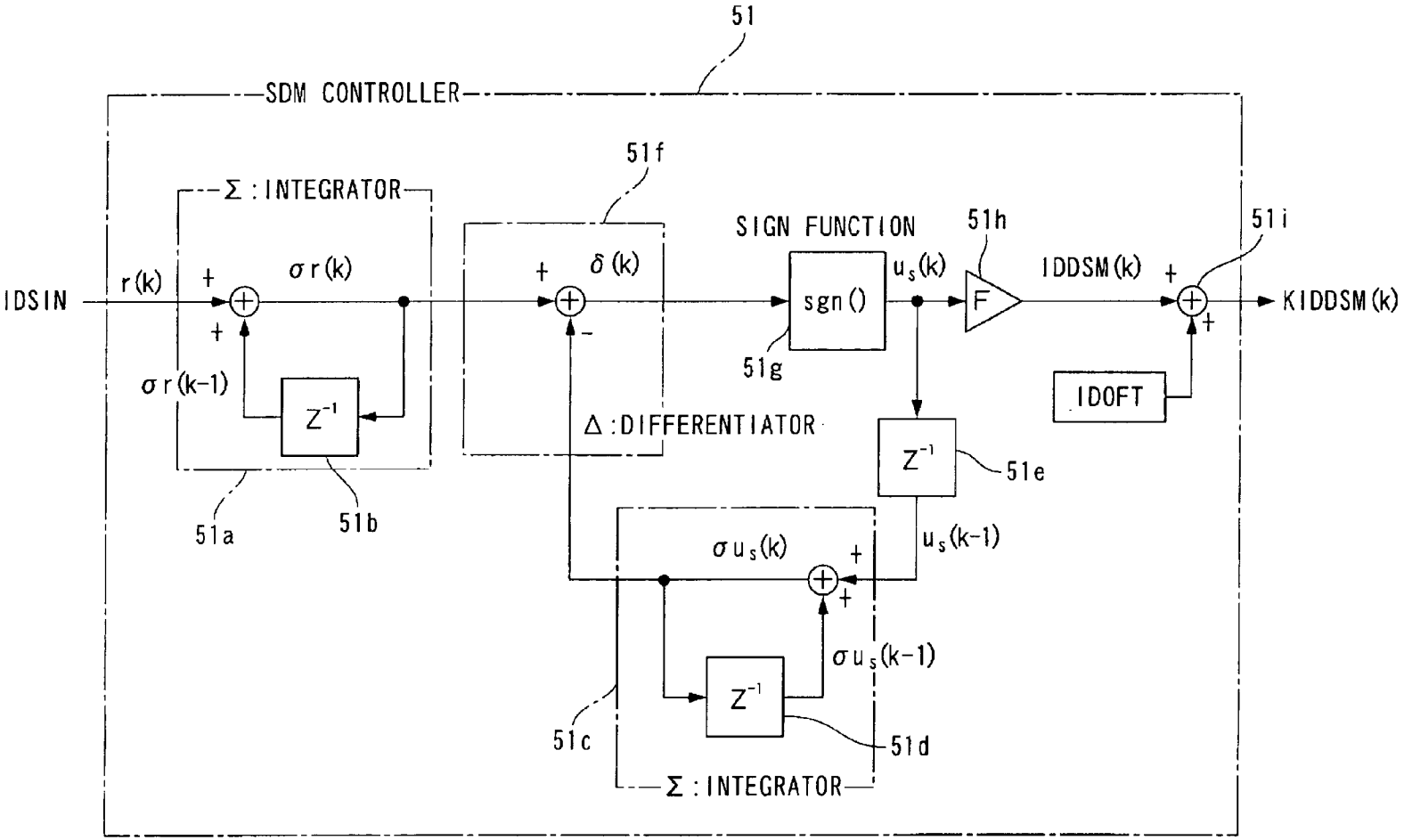
FIG. 12 is a block diagram showing the construction of an SDM controller used in a degradation determining system according to a third embodiment of the present invention.

More specifically, as shown in FIG. 12, the determining input signal IDSIN is input to the SDM controller 51 as the reference signal r(k). Then, an integrator 51*a* generates a reference signal integral value σr(k) as a signal of the sum obtained by adding together a reference signal integral value σr(k−1) obtained by delaying a reference signal integral value σr(k) using a delay element 51*b* and the reference signal r(k). On the other hand, an integrator 51*c* generates an SDM output integral value $\sigma u_s(k)$ as a signal of the sum obtained by adding together an SDM output integral value $\sigma u_s(k-1)$ obtained by delaying the SDM output integral value $\sigma u_s(k)$ using a delay element 51*d* and an SDM output $u_s(k-1)$ obtained by delaying a SDM output $u_s(k)$ using a delay element 51*e*. After that, a differentiator 51*f* generates a deviation signal δ(k) indicative of a deviation between the reference signal integral value σr(k) and the SDM output integral value $\sigma u_s(k)$.

Subsequently, a quantizer 51*g* (sign function) generates the SDM output $u_s(k)$ (modulation output) as a value indicative of a sign determined based on the deviation signal δ(k). Further, an amplifier 51*h* generates an amplified SDM output IDDSM(k) as a value obtained by amplifying the SDM output $u_s(k)$ by the amplitude-adjusting gain F, and then an adder 51*i* generates a fuel reflection coefficient KIDDSM(k) as a value obtained by adding together the amplified SDM output IDDSM(k) and the predetermined offset value IDOFT.

The control algorithm used by the above SDM controller 51 can be expressed by the following equations (10) to (15):

$$\sigma r(k)=\sigma r(k-1)+r(k) \tag{10}$$

$$\sigma u_s(k)=\sigma u_s(k-1)+u_s(k-1) \tag{11}$$

$$\delta(k)=\sigma r(k)-\sigma u_s(k) \tag{12}$$

$$u_s(k)=sgn(\delta(k)) \tag{13}$$

$$IDDSM(k)=F\cdot u_s(k) \tag{14}$$

$$KIDDSM(k)=IDOFT+IDDSM(k) \tag{15}$$

Here, the value of the amplitude-adjusting gain F is set to a predetermined value (e.g. 0.1 A/F). Further, the predetermined offset value IDOFT is set through experiments such that the output KACT from the LAF sensor 12 becomes closer to the target air-fuel ratio KCMD, when the air-fuel ratio is controlled using the fuel injection time period TOUT calculated using the fuel reflection coefficient KIDDSM. Furthermore, the sign function sgn(σ(k)) is configured to assume a value of 1 (sgn(σ(k))=1) when σ(k)≧0 holds, and a value of −1 (sgn(σ(k))=−1) when σ(k)<0 holds. It should be noted that the sign function sgn(σ(k)) may be configured to assume a value of 0 ((sgn((k))=0) when σ(k)=0 holds.

The above control algorithm used by the SDM controller 51, that is, the ΣΔ modulation algorithm is characterized, similarly to the ΔΣ modulation algorithm, in that the SDM output $u_s(k)$ can be generated as a value which when input to a controlled object, causes the reference signal r(k) to be reproduced in the output from the controlled object. More specifically, the SDM controller 51 is characterized in that it can generate a fuel reflection coefficient KIDDSM which is similar to that generated by the DSM controller 33 described above. Therefore, according to the present embodiment, it is possible to obtain the same advantageous effects as provided by the degradation determining system 1 according to the first embodiment. It should be noted that although not shown, the SDM controller 51 calculates the fuel reflection coefficient KIDDSM substantially similarly to the case of the DSM controller 33.

Next, a fourth embodiment of the present invention will be described with reference to FIG. 13. The present embodiment is distinguished from the first embodiment only in that a DM controller 61 (modulation output-generating means) is employed instead of the DSM controller 33. The DM controller 61 calculates the fuel reflection coefficient KIDDSM based on the determining input signal IDSIN, using a control algorithm to which a Δ modulation algorithm is applied.

Figure 13:
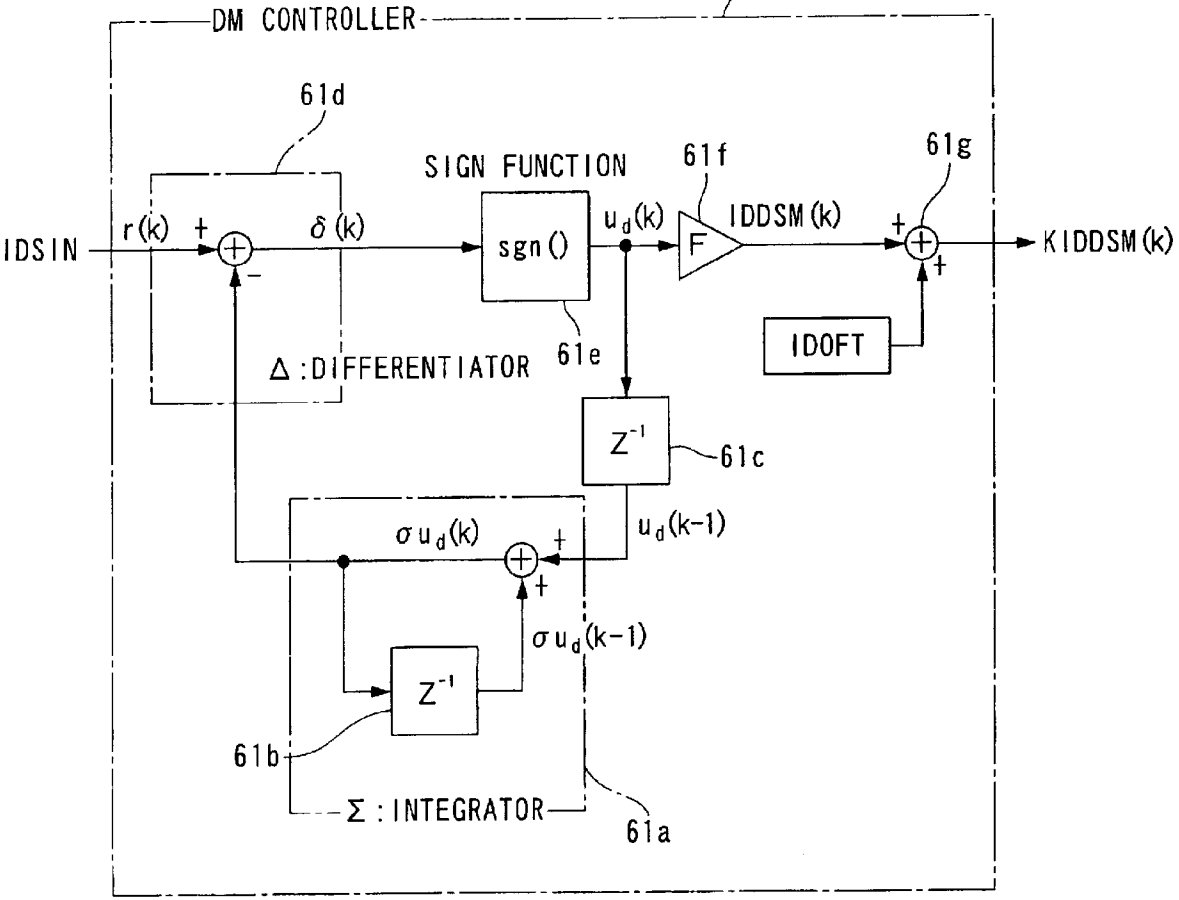
FIG. 13 is a block diagram showing the construction of a DM controller used in a degradation determining system according to a fourth embodiment of the present invention.

More specifically, as shown in FIG. 13, the determining input signal IDSIN is input to the DM controller 61 as the reference signal r(k). Further, an integrator 61*a* generates a DM output integral value $\sigma\ u_d(k)$ as a signal of the sum obtained by adding together a DM output integral value $\sigma u_d(k-1)$ obtained by delaying a DM output integral value $\sigma u_d(k)$ using a delay element 61*b* and a DM output $u_d(k-1)$ obtained by delaying a DM output $u_d(k)$ using a delay element 61*c*. Further, a differentiator 61*d* generates a deviation signal δ(*k*) indicative of a deviation between the reference signal r(k) and the DM output integral value $\sigma u_d(k)$.

Subsequently, a quantizer 61*e* (sign function) generates a DM output $u_d(k)$ (modulation output) as a value indicative of a sign determined based on the deviation signal δ(k). Further, an amplifier 61*f* generates an amplified DM output IDDSM(k) as a value obtained by amplifying the DM output $u_d(k)$ by the amplitude-adjusting gain F, and then an adder 61*g* generates a fuel reflection coefficient KIDDSM(k) as a value obtained by adding together the amplified DM output IDDSM(k) and the predetermined offset value IDOFT.

The control algorithm used by the above DM controller 61 can be expressed by the following equations (16) to (20):

$$\sigma u_d(k)=\sigma u_d(k-1)+u_d(k-1) \quad (16)$$

$$\delta(k)=r(k)-\sigma u_d(k) \quad (17)$$

$$u_d(k)=sgn(\delta(k)) \quad (18)$$

$$IDDSM(k)=F\cdot u_d(k) \quad (19)$$

$$KIDDSM(k)=IDOFT+IDDSM(k) \quad (20)$$

Here, the value of the amplitude-adjusting gain F is set to a predetermined value (e.g. 0.1 A/F). Further, the predetermined offset value IDOFT is set through experiments such that the output KACT from the LAF sensor 12 becomes closer to the target air-fuel ratio KCMD, when the air-fuel ratio is controlled by the fuel injection time period TOUT calculated using the fuel reflection coefficient KIDDSM. Furthermore, the sign function sgn(σ(k)) is configured to assume a value of 1 (sgn(σ(k))=1) when σ(k)≧0 holds, and a value of −1 (sgn(σ(k))=−1) when σ(k)<0 holds. It should be noted that the sign function sgn(σ(k)) may be configured to assume a value of 0 ((sgn(σ(k))=0) when σ(k)=0 holds.

The above control algorithm employed by the DM controller 61, that is, the Δ modulation algorithm is characterized, similarly to the ΔΣ modulation algorithm, in that the DM output $u_d(k)$ can be generated as a value which when input to a controlled object, causes the reference signal r(k) to be reproduced in the output from the controlled object. More specifically, the DM controller 61 is characterized in that it can generate a fuel reflection coefficient KIDDSM which is similar to those generated by the DSM controller 33 and the SDM controller 51. Therefore, according to the present embodiment, it is possible to obtain the same advantageous effects as provided by the degradation determining system 1 according to the first embodiment. It should be noted that although not shown, the DM controller 61 calculates the fuel reflection coefficient KIDDSM substantially similarly to the case of the DSM controller 33.

It should be noted that the present invention is not necessarily limited to the embodiments described above, but can be practiced in various forms. For example, although in the above embodiments, the degradation of the LAF sensor 12 is determined, this is not limitative, but there may be determined degradation of another type of a sensor that outputs a signal indicative of the sensed concentration of oxygen contained in exhaust gases, such as an oxygen concentration sensor which has a characteristic that its output sharply changes when the air-fuel ratio of the exhaust gases changes across the stoichiometric air-fuel ratio, an NOx sensor that detects the concentration of NOx contained in exhaust gases, and an HC sensor that detects the concentration of HC contained in exhaust gases. Further, the determining input signal-generating section 30, and the degradation determining section 31 may be implemented by electric circuits without executing software-based processing based on programs as in the above described embodiments. Further, although in the above described embodiments, the LAF sensor 12 is disposed at a location upstream of the catalytic converter 7, this is not limitative, but it goes without saying that the LAF sensor 12 may be disposed at a location downstream of the catalytic converter 7.

It is further understood by those skilled in the art that the foregoing are preferred embodiments of the present invention, and that various changes and modifications may be made without departing from the spirit and scope thereof.

What is claimed is:

1. A degradation determining system for an exhaust gas sensor, for determining degradation of the exhaust gas sensor based on an output from the exhaust gas sensor, the exhaust gas sensor outputting a signal indicative of an amount of a predetermined component contained in exhaust gases emitted from an internal combustion engine into an exhaust passage thereof, the degradation determining system comprising:

determining input-generating means for generating a determining input for determining degradation of the exhaust gas sensor;

modulation output-generating means for generating a modulation output by modulating the generated determining input, using any one of a ΔΣ modulation algorithm, a ΣΔ modulation algorithm, and a Δ modulation algorithm;

control means for controlling an amount of fuel to be injected into the engine, according to the generated modulation output; and degradation determining means for determining degradation of the exhaust gas sensor based on the output from the exhaust gas sensor delivered when the amount of fuel to be injected is controlled by said control means.

2. A degradation determining system as claimed in claim 1, further comprising a bandpass filter for filtering the output from the exhaust gas sensor input thereto, such that components of the output from the exhaust gas sensor corresponding to a predetermined frequency band including a frequency of the determining input are allowed to pass therethrough, and wherein said degradation determining means determines degradation of the exhaust gas sensor based on the output of the exhaust gas sensor, the output having been filtered by said bandpass filter.

3. A degradation determining system as claimed in claim 1, wherein said degradation determining means determines degradation of the exhaust gas sensor based on the output from the exhaust gas sensor, after a predetermined time period has elapsed from a start of control of the amount of fuel to be injected by said control means.

4. A degradation determining system as claimed in claim 1, wherein said degradation determining means determines degradation of the exhaust gas sensor based on a state of changes in amplitude of the output from the exhaust gas sensor.

5. A degradation determining system as claimed in claim 1, further comprising cumulative value-generating means for generating a cumulative value by adding up a plurality of values of the output from the exhaust gas sensor delivered at respective different times, and wherein said degradation determining means determines degradation of the exhaust gas sensor based on the generated cumulative value.

6. A degradation determining system as claimed in claim 1, wherein said control means controls the amount of fuel to be injected according to a value obtained by adding together the modulation output generated by said modulation output-generating means and a predetermined value.

7. A degradation determining system as claimed in claim 1, wherein the exhaust gas sensor is an air-fuel ratio sensor that outputs a signal indicative of a sensed concentration of oxygen contained in the exhaust gases, and wherein the degradation determining system further comprises correction means for correcting the amount of fuel to be injected in response to the output from the air-fuel ratio sensor.

8. A degradation determining method of determining degradation of an exhaust gas sensor based on an output from the exhaust gas sensor, the exhaust gas sensor outputting a signal indicative of an amount of a predetermined component contained in exhaust gases emitted from an internal combustion engine into an exhaust passage thereof, the degradation determining method comprising the steps of:

generating a determining input for determining degradation of the exhaust gas sensor;

generating a modulation output by modulating the generated determining input, using any one of a $\Delta\Sigma$ modulation algorithm, a $\Sigma\Delta$ modulation algorithm, and a $\Delta$ modulation algorithm;

controlling an amount of fuel to be injected into the engine, according to the generated modulation output; and determining degradation of the exhaust gas sensor based on the output from the exhaust gas sensor delivered when the amount of fuel to be injected is controlled in said controlling step.

9. A degradation determining method as claimed in claim 8, further comprising the step of inputting the output from the exhaust gas sensor to a bandpass filter to thereby perform filtering such that components of the output from the exhaust gas sensor corresponding to a predetermined frequency band including a frequency of the determining input are allowed to pass therethrough, and wherein said degradation determining step includes determining degradation of the exhaust gas sensor based on the output of the exhaust gas sensor, the output having been filtered by said bandpass filter.

10. A degradation determining method as claimed in claim 8, wherein said degradation determining step includes determining degradation of the exhaust gas sensor based on the output from the exhaust gas sensor, after a predetermined time period has elapsed from a start of control of the amount of fuel to be injected in said controlling step.

11. A degradation determining method as claimed in claim 8, wherein said degradation determining step includes determining degradation of the exhaust gas sensor based on a state of changes in amplitude of the output from the exhaust gas sensor.

12. A degradation determining method as claimed in claim 8, further comprising the step of generating a cumulative value by adding up a plurality of values of the output from the exhaust gas sensor delivered at respective different times, and wherein said degradation determining step includes determining degradation of the exhaust gas sensor based on the generated cumulative value.

13. A degradation determining method as claimed in claim 8, wherein said controlling step includes controlling the amount of fuel to be injected according to a value obtained by adding together the modulation output generated in said modulation output-generating step and a predetermined value.

14. A degradation determining method as claimed in claim 8, wherein the exhaust gas sensor is an air-fuel ratio sensor that outputs a signal indicative of a sensed concentration of oxygen contained in the exhaust gases, and wherein the degradation determining method further includes the step of correcting the amount of fuel to be injected in response to the output from the air-fuel ratio sensor.

15. An engine control unit including a control program for causing a computer to perform a degradation determining process for determining degradation of an exhaust gas sensor based on an output from the exhaust gas sensor, the exhaust gas sensor outputting a signal indicative of an amount of a predetermined component contained in exhaust gases emitted from an internal combustion engine into an exhaust passage thereof, wherein the program causes the computer to generate a determining input for determining degradation of the exhaust gas sensor, generate a modulation output by modulating the generated determining input, using any one of a $\Delta\Sigma$ modulation algorithm, a $\Sigma\Delta$ modulation algorithm, and a $\Delta$ modulation algorithm, control an amount of fuel to be injected into the engine, according to the generated modulation output, and determine degradation of the exhaust gas sensor based on the output from the exhaust gas sensor delivered when the program causes the computer to control the amount of fuel to be injected based on the generated modulation output.

16. An engine control unit as claimed in claim 15, wherein the program causes the computer to input the output from the exhaust gas sensor to a bandpass filter to thereby cause the bandpass filter to perform filtering such that components of the output from the exhaust gas sensor corresponding to a predetermined frequency band including a frequency of the determining input are allowed to pass through the bandpass filter, and wherein when the program causes the computer to determine degradation of the exhaust gas sensor, the program causes the computer to determine degradation of the exhaust gas sensor based on the output of the exhaust gas sensor, the output having been filtered by said bandpass filter.

17. An engine control unit as claimed in claim 15, wherein when the program causes the computer to determine degradation of the exhaust gas sensor, the program causes the computer to determine degradation of the exhaust gas sensor based on the output from the exhaust gas sensor, after a predetermined time period has elapsed from a start of control of the amount of fuel to be injected based on the generated modulation output.

18. An engine control unit as claimed in claim 15, wherein when the program causes the computer to determine degradation of the exhaust gas sensor, the program causes the computer to determine degradation of the exhaust gas sensor based on a state of changes in amplitude of the output from the exhaust gas sensor.

19. An engine control unit as claimed in claim 15, wherein the program causes the computer to generate a cumulative value by adding up a plurality of values of the output from the exhaust gas sensor delivered at respective different times, and wherein when the program causes the computer to determine degradation of the exhaust gas sensor, the program causes the computer to determine degradation of the exhaust gas sensor based on the generated cumulative value.

20. An engine control unit as claimed in claim 15, wherein when the program causes the computer to control the amount of fuel to be injected based on the generated modulation output, the program causes the computer to control the amount of fuel to be injected according to a value obtained by adding together the modulation output and a predetermined value.

21. An engine control unit as claimed in claim 15, wherein the exhaust gas sensor is an air-fuel ratio sensor that outputs a signal indicative of a sensed concentration of oxygen contained in the exhaust gases, and wherein the program causes the computer to correct the amount of fuel to be injected in response to the output from the air-fuel ratio sensor.

* * * * *